US007135260B2

(12) United States Patent
Miyakawa et al.

(10) Patent No.: US 7,135,260 B2
(45) **Date of Patent: *Nov. 14, 2006**

(54) IMAGING SYSTEM

(75) Inventors: Nobuhiro Miyakawa, Nagano-Ken (JP); Shinji Yasukawa, Nagano-Ken (JP); Mikio Furumizu, Nagano-Ken (JP); Nobumasa Abe, Nagano-Ken (JP); Masanao Kunugi, Nagano-Ken (JP); Yoshiro Koga, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 207 days.

This patent is subject to a terminal disclaimer.

(21) Appl. No.: 10/751,306

(22) Filed: Jan. 5, 2004

(65) Prior Publication Data

US 2004/0265714 A1 Dec. 30, 2004

(30) Foreign Application Priority Data

| | | |
|---|---|---|
| Jan. 8, 2003 | (JP) | 2003-002223 |
| Jan. 15, 2003 | (JP) | 2003-007288 |
| Dec. 26, 2003 | (JP) | 2003-433363 |

(51) Int. Cl.
*G03G 15/01* (2006.01)

(52) U.S. Cl. ..... 430/45; 430/47; 430/107.1; 430/111.4; 430/126; 399/228; 399/231

(58) Field of Classification Search ..... 399/228, 399/231; 430/45, 47, 111.4, 107.1, 126
See application file for complete search history.

(56) References Cited

U.S. PATENT DOCUMENTS 6,875,550 B1 * 4/2005 Miyakawa et al. ..... 430/108.6

FOREIGN PATENT DOCUMENTS

| | | | |
|---|---|---|---|
| JP | 05-027548 | A | 2/1993 |
| JP | 05-307310 | A | 11/1993 |
| JP | 06-194943 | A | 7/1994 |
| JP | 08-248779 | A | 9/1996 |
| JP | 10-207164 | A | 8/1998 |
| JP | 10-260563 | A | 9/1998 |
| JP | 2000-206755 | A | 7/2000 |
| JP | 2002-031933 | A | 1/2002 |
| JP | 2002-131973 | A | 5/2002 |

* cited by examiner

*Primary Examiner*—Mark A. Chapman
(74) *Attorney, Agent, or Firm*—Sughrue Mion, PLLC

(57) ABSTRACT

The invention provides an imaging system wherein toners of two or more colors are used to form toner images and the toner images are successively used to form a color image on a recording material. The imaging system can form an image with high transfer efficiency. An electrostatic latent image is formed on an image carrier. Using developing units for two or more colors, images are formed. Then, the images are successively transferred onto an intermediate transfer medium at a transfer voltage fed from a constant-voltage power supply. The developing units are located such that development occurs in descending toner work function order.

9 Claims, 8 Drawing Sheets

(A)

(B)

(C)

(A)

(B)

(C)

IMAGING SYSTEM

BACKGROUND OF THE INVENTION

The present invention relates generally to an imaging system, and more particularly to an imaging system wherein toner images are successively formed on an image carrier using toners of two or more colors, and the images are then transferred onto an intermediate transfer medium at an applied transfer voltage, followed by transfer of the images on a recording material such as paper.

Among various imaging systems for forming color images known so far in the art, there is a specific imaging system wherein images successively visualized by toners of two or more are formed on a latent image carrier, an image with the colors put one upon another is formed on an intermediate transfer medium at an applied transfer voltage and then transferred onto a recording medium such as paper by one operation, and the toners are softened by the application of heat, pressure, etc. to fix toner images on the recording medium, thereby forming a color image.

To enhance the definition of the color image to be formed thereby reducing the amount of the toner used, it has been proposed to use toner particles having a reduced particle diameter.

However, a problem with the use of toner particles having such a reduced particle diameter is that frictional electrification of the toner particles with the surface of a development roller or a regulated blade becomes difficult, resulting in insufficient charges. Consequently, even a negative charge toner will unavoidably contain positively charged particles due to the presence of a charge quantity distribution in the toner, ending up with fog of a non-image area on an image carrier. To eliminate such fog, it is known to increase regulated pressure in a non-magnetic one-component development process. However, this can cause overcharging of toner, often resulting in a decrease in the toner density upon development or a transfer efficiency drop. To avoid these problems, JP06194943A proposes to control the amount of the toner deposited on a development roller in a proper range.

US2002076630 (JP2002131973A) proposes to use toner particles having a small diameter, thereby controlling the maximum amount of the toner to be deposited onto the recording material of each color in a given range and, hence, improving chargeability and particle image quality. However, this may be effective for improving the low-temperature fixation capability of the toner so that the toner is uniformly fixed, but is still insufficient for the transfer efficiency of the toner.

JP08248779A proposes a method for the formation of full-color images, wherein a latent image formed on a photosensitive member is developed with yellow, magenta and cyan toners as well as a black toner, each toner image is transferred onto an intermediate transfer medium, and an image developed with the black toner is superposed by primary transfer on the intermediate transfer medium and put by secondary transfer on other recording material.

The publication alleges that the intermediate transfer medium is not charged by repetition of the primary transfer so that the transfer efficiency of the black toner that is developed and primarily transferred in the last step is improved. However, the transfer efficiency of the toners is still less than satisfactory.

JP2000206755A proposes a color imaging system wherein for development a black toner is first used and yellow, magenta and cyan toners are then used, whereby mixing of the black toner with other color toners is so avoided that only the black toner can be recycled. However, the efficiency of transfer of the toners onto paper is again still insufficient.

JP200231933A proposes a color imaging system wherein toner images are formed on both sides of a recording material via an intermediate transfer medium, and yellow, magenta, cyan and black toner images are put one upon another in the order of cyan, yellow and magenta or vice versa, and black. However, the efficiency of transfer of the toners is still unsatisfactory.

JP10207164 proposes development of toners in ascending charge quantity order, and JP10260563 proposes to increase toner transfer voltage for each color, thereby enhancing transfer efficiency.

JP0527548A proposes to determine toner transfer voltage in such a way as to maximize the transfer efficiency of the lowermost toner layer, and JP200231933A proposes to use toners in the order of cyan, yellow and magenta or vice versa, and black.

For instance, JP05307310A teaches that development is carried out in the order of cyan, yellow, magenta, and black.

When toners of two or more colors are put one upon another for image formation, it is required to put the second and subsequent toners on the previously formed toner image; it is required that stable toner images be formed on the previously formed toner image.

Unless the second and subsequent toner images are precisely registered on the first toner image or at a position adjacent to the first toner image in the case of halftone, images having the desired color tone are hardly obtainable or image quality drops due to a scattering of toner particles.

When the formed toner images are transferred onto an intermediate transfer medium at a transfer voltage fed from a constant-voltage power supply, it is less likely to provide precise transfer of all the toner images or application of high transfer voltage is often needed.

One aspect of the present invention relates to an imaging system wherein an electrostatic latent image is formed on a latent image carrier, and a black toner or color toner of two or more colors are used to put colors one upon another so that the resultant image can be transferred and fixed onto an intermediate transfer medium or a recording material. According to this aspect, an object of the present invention is to take advantage of functional differences between the black toner and other color toners, thereby achieving a color imaging system, which enables a color image to be formed through a fixing step with high transfer efficiency but without causing misalignments of toner images obtained by transfer of toners onto an intermediate transfer medium or a recording material in a superposed fashion, and which enables the amount of the toners remaining on a photosensitive member upon transfer to be substantially reduced so that the quality of the resultant image can be improved.

Another aspect of the present invention also relates to an imaging system wherein toners of two or more colors are used on a photosensitive member to successively put colors one upon another on an intermediate transfer medium at an applied transfer voltage thereby forming a color image, which is then transferred by one operation onto a recording material such as paper or synthetic resin film, so that the color image can be fixed in a fixing step. According to this aspect, an object of the present invention is to provide an imaging system which enables a color image to be transferred with high transfer efficiency but without causing misalignments of the transferred color images, and which enables the amount of toners remaining on a photosensitive member upon transfer to be substantially reduced so that the quality of the resultant image can be improved.

SUMMARY OF THE INVENTION

Figure 1:
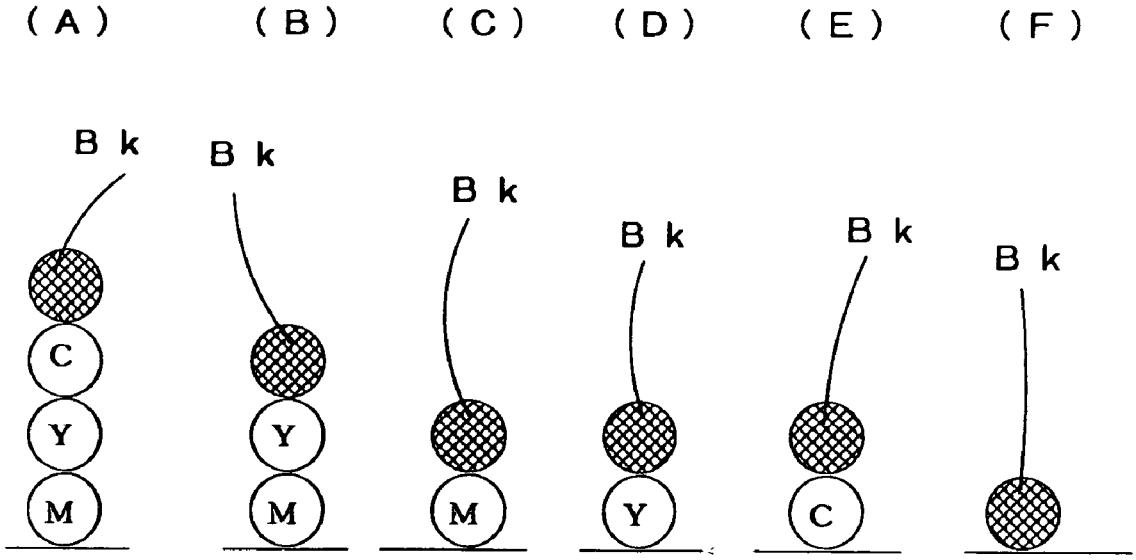
FIGS. 1(A), 1(B), 1(C), 1(D), 1(E) and 1(F) are illustrative of how to form images with a black toner and other toners of two or more colors.

The present invention provides an imaging system wherein an electrostatic late image is formed on a latent image carrier and a color image is formed by putting colors one upon another using a black toner or other toners of two or more colors, wherein at least a toner having the largest work function is first transferred onto an intermediate transfer medium.

Toner images are successively formed on the intermediate transfer medium, and the thus formed toner images are fixed after transferred onto the intermediate transfer medium by one operation.

Developing units for two or more colors are located such that development occurs in descending toner work function order to form images, and the images are successively transferred onto the intermediate transfer medium at a transfer voltage fed from a constant-voltage power supply.

The imaging system is free from any cleaner for removal of toner residues remaining on the latent image carrier after transfer.

The average quantity of charges on the toner having the same polarity as the latent image carrier has an absolute value of 16 μC/g or lower, and the number of toner particles contained in the toners on the latent image carrier after development and transferred onto a recording material and opposite in polarity to the electrostatic latent image on a photosensitive member is 5% or lower.

Thus, the present invention provides an imaging system wherein an electrostatic image formed on a latent image carrier is developed with toners in descending toner work function order, and the resulting toner images are successively transferred onto an intermediate transfer medium at a transfer voltage fed from a constant-voltage power supply to form a color image. With this imaging system, the amount of toner residues on the image carrier can be much reduced, and the toner images to be transferred can be precisely registered on the previously transferred toner image, so that color images of improved image quality can be obtained.

For the imaging system of the invention wherein the amount of toner residues on the latent image carrier can be much reduced, therefore, it is unnecessary to rely on any cleaner for removal of toner remnants on the latent image carrier or any means for collection of waste toners that are otherwise to be collected by a cleaner, thereby assuring a reduction in system size and simplified maintenance operations.

The image carrier with the image being to be formed thereon is an organic photosensitive member.

A negatively charged toner and a reversal development unit are used.

The amount of the toner developed on the latent image carrier is controlled to 0.55 mg/cm$^2$ or lower.

Thus, the amount of the toner deposited onto the latent image carrier upon development is controlled to 0.55 mg/cm$^2$ or lower, so that the primary transfer voltage applied to the recording material can be kept low, with the result that discharge at a non-image area between the recording material and the latent image carrier upon the primary transfer can be minimized, thereby preventing a scattering of toner particles. The primary transfer voltage can also be kept low by carrying out development with the toners in descending toner work function order, so that color toner images of higher image quality can be obtained.

The peripheral speed ratio of a development roller to the latent image carrier is at least 1.1 to 2.5.

The present invention also provides a toner used with an imaging system wherein an electrostatic latent image is formed on a latent image carrier, and a color image is formed by putting colors one upon another using a black toner or other toners of two or more colors, wherein at least a toner having the largest work function is first transferred onto an intermediate transfer medium, wherein said toner contains as a flowability improver at least a hydrophobic silicon dioxide particle and a hydrophobic titanium dioxide particle.

Developing units for two or more colors are located such that development occurs in descending toner work function order to form images, and the images are successively transferred onto the intermediate transfer medium at a transfer voltage fed from a constant-voltage power supply.

The toner has a circularity of 0.94 or higher as expressed in terms of $L_0/L_1$ wherein $L_1$ is the peripheral length in μm of a projected image of a toner particle as found by measurement of the projected image and $L_0$ is the peripheral length in μm of a true circle equal in area to the projected image.

The toner has a number base average particle diameter of 4.5 to 9 μm.

The toner has been obtained by the polymerization of at least one of a monomer and an oligomer of a polymerizable organic compound, with a coloring agent contained therein.

With the imaging system of the invention wherein the transfer efficiency for each color is improved, toner residues on the latent image carrier upon transfer can be much reduced. As a result, wear losses of the latent image carrier and the amount of the cleaning toner to be used can be reduced due to cleaning load reductions, so that the volume of a vessel for collecting the cleaning toner can be much reduced, contributing to size reductions of the imaging system.

DESCRIPTION OF THE PREFERRED EMBODIMENTS

In the imaging system of the invention wherein an electrostatic latent image on an image carrier is formed into an image by putting colors one upon another with a black toner or other toners of two or more colors so that the image can be transferred onto a recording material, it has been found that if the image is transferred from at least the toner having the largest work function onto an intermediate transfer medium, it is then possible to form an image with high transfer efficiency.

In the imaging system of the invention wherein an electrostatic latent image on an image carrier is successively developed by means of toners of two or more colors for transfer onto an intermediate transfer medium at a constant transfer voltage, it has been found that if the order of development of the toners of two or more colors is such that the work function of a previously developed toner is larger than that of the next toner, it is then possible to form an image with high transfer efficiency.

The work functions of the toners and latent image carrier in the invention are now explained.

The work function of a substance is known as the energy required for extraction of electrons from that substance; the smaller the work function the more likely the substance is to emit electrons, and the larger the work function the more unlikely the substance is to emit electrons. Upon contact of a substance having a small work function with a substance having a large work function, therefore, the substance having a small work function is positively charged whereas the substance having a large work function is negatively charged.

The work function of a substance is measured by the following measuring method, and is expressed in term of a numerical value indicative of the energy (eV) required for extraction of electrons from that substance. The work function can be used to evaluate charge capability due to contact of a toner comprising various substances with various parts of an imaging system.

The work function (Φ) is measured using a surface analyzer (of the low-energy electron counter type, for instance, AC-2 made by Riken Keiki Co., Ltd.). Specifically, the surface analyzer is used in combination with a deuterium lamp. Monochromatic light selected through a spectroscope is directed to a sample at an irradiation area of 4 mm square, an energy scanning range of 3.4 to 6.2 eV and a measuring time of 10 sec/spot. Then, photoelectrons emitted out of the surface of the sample are detected. The work function is measured with a repeat accuracy (standard deviation) of 0.02 eV. To insure data reproducibility, the sample should be allowed to stand alone in a specific measuring environment at a temperature of 25° C. and a humidity of 55% RH for 24 hours prior to measurement.

FIGS. 1(A), 1(B), 1(C), 1(D), 1(E) and 1(F) are illustrative of how to form an image with a black toner and other toners of two or more colors.

Referring to the formation of an image by a black toner Bk, black is created by the additive color process of toners of two or more colors, followed by further addition of the black toner Bk, as shown in FIG. 1(A). Alternatively, a black toner Bk is put on an image formed by toners of other colors, as shown in FIGS. 1(B), 1(C), 1(D), 1(E), etc., thereby making contrast improvements, etc.

As shown in FIG. 1(F), an image constructed mainly of textual information may be formed only by use of a black toner Bk without recourse to other toners of two or more colors.

Thus, the black toner Bk is used in modes different from those for toner images created by other toners of two or more colors, and even upon two or more colors put one another, any black toner is hardly.

According to the present invention, it has been found that when an image is formed by putting colors one upon another with a black toner and other toners of two or more colors, it is possible to form an improved color image by transferring an image created from at least a toner having the largest work function onto a recording material, because the image can be precisely registered on the previously transferred toner image.

Figure 2:
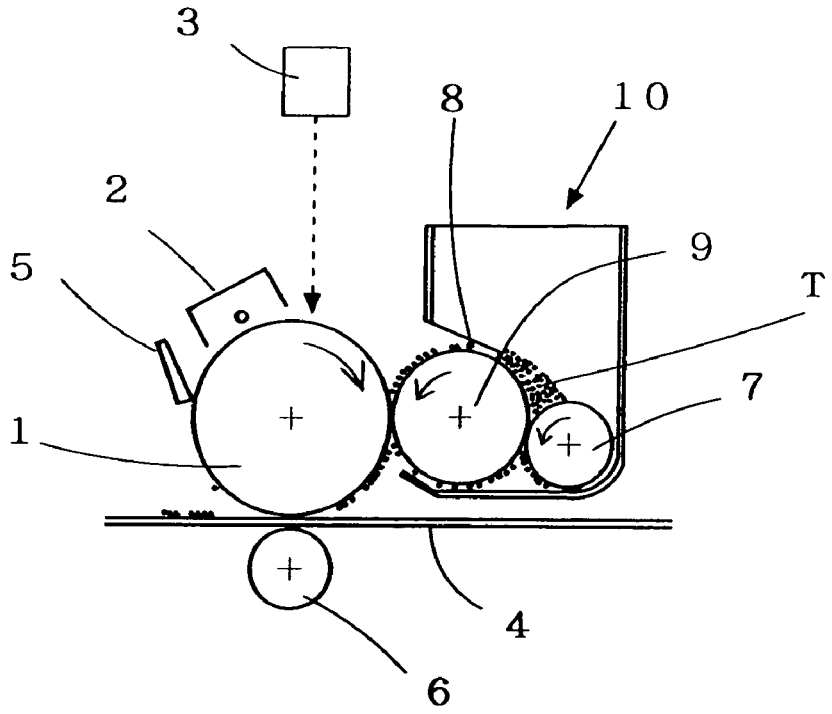
FIG. 2 is illustrative of one embodiment of the imaging system according to the invention.

FIG. 2 is illustrative of the imaging system of the invention.

Specifically, FIG. 2 shows one exemplary embodiment of a contact developing process well fit for the imaging system using toners according to the invention. A photosensitive member 1 is a photosensitive drum that has a diameter of 24 to 86 mm and rotates at a surface speed of 60 to 300 mm/s. After uniformly negatively charged on the surface of the drum by means of a corona charger 2, the drum is exposed to light, as shown at 3, depending on the information to be recorded.

A developing unit 10 is of the one-component developing type wherein a one-component non-magnetic toner T is fed onto an organic photosensitive member for reversal development of an electrostatic latent image on the organic photosensitive member, thereby making that image visible. A developing means receives the one-component non-magnetic toner T, and feeds the toner to a development roller 9 by means of a toner feed roller 7 that rotates counterclockwise as shown. Rotating counterclockwise, the development roller 9 delivers the toner T, carried by the toner feed roller 7, to a portion of contact with the organic photosensitive member while the roller 9 holds the toner T on its surface, so that the electrostatic latent image on the organic photosensitive member 1 is rendered visible.

The development roller 9 is constructed of a metallic tube having a diameter of, e.g., 16 to 24 mm and subjected to blasting or plating or, alternatively, a metallic tube provided around its center axis with an electrically conductive elastic layer formed of, e.g., butadiene rubber, styrene-butadiene rubber, ethylene-propylene rubber, urethane rubber or silicone rubber and a volume resistance value of $10^4$ to $10^8$ Ω·cm and a hardness of 40 to 70° (Ascar A hardness). For instance, a development bias voltage is applied to the development roller 9 via an axis of the tube, not shown. The developing unit 10 comprising development roller 9, toner feed roller 7 and a toner regulated blade 8 is engaged with the organic photosensitive member by means of biasing means such as springs (not shown) with a force of 19.6 to 98.1 N/m, preferably 24.5 to 68.6 N/m at a nip width of 1 to 3 mm.

The regulated blade 8 used, for instance, is formed of a thin stainless, phosphor bronze, rubber or metal sheet with a rubber chip laminated thereon. The regulated blade is engaged with the development roller by means of biasing means such as springs (not shown) or making use of a repulsion force of an elastic member (not shown) at a linear pressure of 245 to 490 mN/cm, so that about one or two toner layers are formed on the development roller.

For the contact development mode, the photosensitive member should preferably be at a dark potential of −500 to −700 V and at a light potential of −50 to −150 V, and the development bias voltage should preferably be −100 to −400 V with the development roller and toner feed roller being at the same potential, although not shown.

In the contact development mode, the peripheral speed of the development roller that rotates counterclockwise should preferably be such that the peripheral speed rate with respect to the organic photosensitive member that rotates clockwise is in the range of 1.1 to 2.5, and preferably 1.2 to 2.2. This ensures that even toner particles having small diameters can be charged due to contact friction with the organic photosensitive member.

Although there is no specific restriction on the relations between the work functions of the regulated blade and development roller and the work function of the toner, it is preferable that the work functions of the regulated blade and development roller are smaller than that of the toner, so that the toner contacting the regulated blade can be negatively charged; it is possible to make negative charges on the toner more uniformly. Alternatively, voltage may be applied to the regulated blade 8 for injection of charges in the toner contacting the blade, thereby controlling the amount of charges on the toner.

The intermediate transfer medium in the imaging system of the invention is now explained. Referring to FIG. 2, an intermediate transfer medium 4 is fed between a photosensitive member 1 and a backup roller 6 for application of voltage thereto, whereby a visible image on the photosensitive member 1 is transferred onto the intermediate transfer medium to form a toner image thereon. Toner residues on the photosensitive member are removed by means of a cleaning blade 5 and electrostatic charges on the photosensitive member are erased off by means of an erasing lamp, so that the photosensitive member can be reused.

With the imaging system of the invention, it is possible to keep the toner from being reversely charged thereby reducing the amount of toner residues on the photosensitive member and, hence, decreasing the size of a cleaning toner vessel.

In addition, any cleaning is not necessary under given conditions; it is possible to provide a so-called cleaner-free imaging system that can dispense with the cleaning blade 5 or the cleaning toner vessel.

When a transfer drum or belt is used for the intermediate transfer medium, a primary transfer voltage of +250 to +600V should preferably be applied to an electrically conductive layer thereof and a secondary transfer voltage of +400 to +2,800 V should preferably be applied to a recording material such as paper.

Thus, the transfer belt or drum can be used as the intermediate transfer medium. The transfer belt used comprises a synthetic resin substrate film or sheet with a transfer layer provided thereon or an elastic substrate layer with a transfer layer provided as a surface layer thereon. When the photosensitive member is a rigid drum, for instance, an aluminum drum with an organic photosensitive layer provided thereon, the transfer medium used may comprise a rigid drum substrate such as an aluminum drum substrate with a transfer layer provided as a surface elastic layer. When the photosensitive member is a so-called elastic photosensitive member wherein an elastic support substrate such a belt-like or rubber support substrate includes thereon a photosensitive layer, the transfer medium used may comprise a rigid drum substrate such as an aluminum substrate on which a transfer layer is provided directly or via an electrically conductive intermediate layer.

For the substrate, an electrically conductive or insulating substrate is usable. For the substrate for the transfer belt, it is preferable to have a volume resistance in the range of $10^4$ to $10^{12}$ Ω·cm, and preferably $10^6$ to $10^{11}$ Ω·cm.

A preferable film and sheet is formed of engineering plastics such as modified polyimides, thermally cured polyimides, polycarbonates, ethylene-tetrafluoroethylene copolymers, polyvinylidene fluorides or nylon alloys. Specifically, a 50 to 500-μm thick semiconductive film substrate formed of such plastics with electrically conductive materials such as electrically conductive carbon black, electrically conductive titanium oxide, electrically conductive tin oxide or electrically conductive silica dispersed therein is extruded or formed into a seamless substrate. Then, the seamless substrate is coated thereon with a fluororesin at a thickness of 5 to 50 μm as a surface protective layer for lowering surface energy and preventing toner filming thereby forming a seamless belt.

The surface protective layer may be formed by dip coating, ring coating, spray coating or the like. It is noted that in order to prevent cracks and elongation at the ends of the transfer belt or prevent the transfer belt from running in a meandering fashion, 80-μm thick tapes such as polyethylene terephthalate films or ribs such as urethane rubber ribs are affixed to both ends of the transfer belt.

When a film or sheet substrate is used, a belt may be prepared by ultrasonic fusion of the end faces of the substrate. Specifically, a transfer belt having the desired physical properties may be prepared by ultrasonic fusion of the film or sheet substrate after provided thereon with an electrically conductive layer and a surface layer. To be more specific, when a 60 to 150-μm thick polyethylene terephthalate substrate is used as an insulating substrate, a transfer belt may be prepared by forming aluminum or the like on the surface of the substrate by means of evaporation, optionally coating thereon with an intermediate conductive layer comprising an electrically conductive material such as carbon black and a resin, and providing the aluminum or intermediate conductive layer with a semiconductive surface layer formed of urethane resin, fluororesin and electrically conductive material having higher surface resistance. A resistance layer for which heat is less needed for post-coating drying may be used to form the transfer belt. In this case, the aluminum deposited film may first be subjected to ultrasonic fusion, followed by the provision of the above resistance layer.

A preferable material for the rubber or elastic substrate is silicone rubber, urethane rubber, nitrile rubber, and ethylene-propylene rubber. The rubber with the above conductive material dispersed therein is first extruded into a 0.8 to 2.0-mm thick semiconductive rubber belt, the surface of which is then controlled to a desired surface roughness by means of an abrasive material such as sand paper or a polisher. The resulting elastic layer may be used as such; however, it is acceptable to provide it with the surface protective layer as described above.

The transfer drum should preferably have a volume resistance in the range of $10^4$ to $10^{12}$ Ω·cm, and especially $10^7$ to $10^{11}$ Ω·cm. For instance, the transfer drum may be prepared by providing an aluminum or other metal cylinder with an elastic, electrically conductive layer, if required, to form an elastic, electrically conductive substrate, and providing this substrate with a 5 to 50-μm thick semiconductive fluororesin coating as a surface protective layer for lowering surface energy and preventing toner filming.

For instance, the elastic, electrically conductive substrate may be prepared by using an electrically conductive material comprising a rubber material such as silicone rubber, urethane rubber, nitrile rubber (NBR), ethylene-propylene rubber (EPDM), butadiene rubber, styrene-butadiene rubber, isoprene rubber, chloroprene rubber, butyl rubber, epichlorohydrin rubber or fluoro-rubber, in which an electrically conductive material such as carbon black, electrically conductive titanium oxide, electrically conductive tin oxide or electrically conductive silica is blended, kneaded and dispersed. The rubber material is then formed in close contact with an aluminum cylinder having a diameter of 90 to 180 mm, and polished to a thickness of 0.8 to 6 mm and a volume resistance of $10^4$ to $10^{10}$ Ω·cm. Subsequently, an about 15 to 40-μm thick semiconductive surface layer comprising fine particles based on urethane resin, fluororesin, electrically conductive material, and fluorine-based resin is provided on the formed rubber material so that a transfer drum having a volume resistance of $10^7$ to $10^{11}$ Ω·cm as desired can be obtained. The obtained transfer drum should preferably have a surface roughness of up to 1 μm (Ra). In an alternative embodiment of this aspect of the invention, a transfer drum having a surface layer and electrical resistance as desired may be prepared by placing the thus prepared elastic, electrically conductive substrate in a semiconductive fluororesin tube, and heating the tube for shrinkage.

Figure 3:
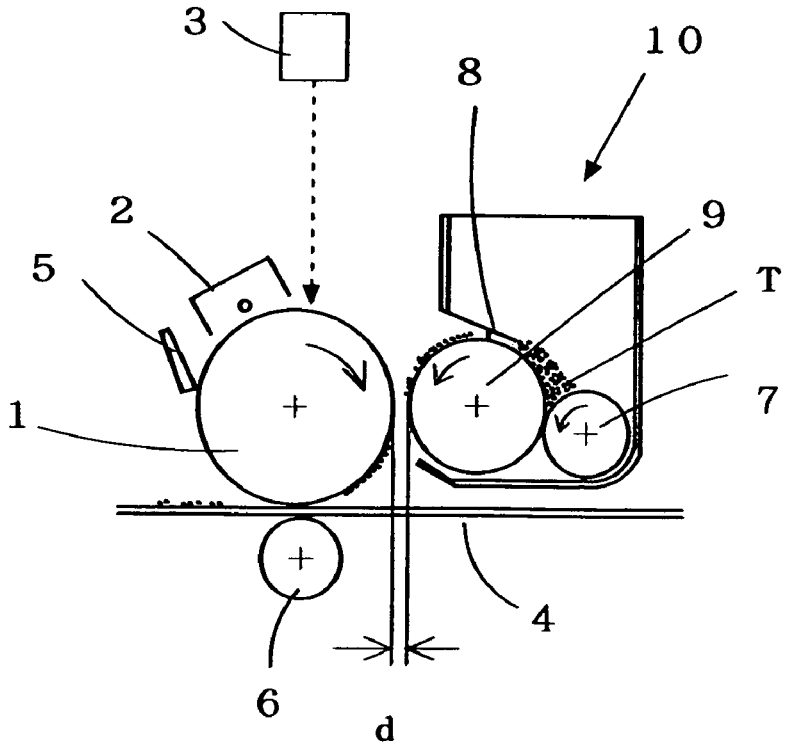
FIG. 3 is illustrative of another embodiment of the imaging system according to the invention.

FIG. 3 is illustrative of one exemplary embodiment of the non-contact development process well fit for the imaging system using toners according to the invention. In this embodiment, a development roller 9 is opposed to a photosensitive member 1 with a developing gap d between them. The developing gap should preferably be between 100 μm and 350 μm, and although not shown, the DC development bias voltage should preferably be between −200 V and −500 V while the AC voltage superposed thereon should preferably be a P-P voltage in the range of 1,000 and 1,800 V at 1.5 to 3.5 kHz. For the non-contact development process, the peripheral speed of the development roller rotating counterclockwise should preferably be such that the peripheral speed ratio with respect to the organic photosensitive member rotating clockwise is in the range of 1.1 to 2.5, and preferably 1.2 to 2.2.

As shown, the development roller 9 rotates counterclockwise to deliver a toner T, carried by a toner feed roller 7, to an opposite portion of an organic photosensitive member while the toner T is adsorbed onto the surface thereof. At the opposing portions of the organic photosensitive member and the development roller, the toner T is vibrated between the surface of the development roller and the surface of the organic photosensitive member for development. According to the invention wherein toner particles are allowed to contact the organic photosensitive member while the toner T is vibrated by the application of the AC voltage between the surface of the development roller and the surface of the organic photosensitive member, positively charged toner particles having a small particle diameter could be positively charged.

An intermediate transfer medium is fed between a visualized photosensitive member 1 and a backup roller 6. In this case, however, the force of the backup roller 6 acting on the photosensitive member 1 should preferably be about 1.3 times as high as that in the contact development process, say, 24.5 to 58.8 mN/m, and preferably 34.3 to 49 mN/m.

This ensures contact of toner particles with the photosensitive member so that more toner particles can be negatively charged resulting in transfer efficiency improvements.

It is here noted that the rest of the non-contact development process may be the same as in the above contact development process, and so a cleaner blade 5 may be removed from the imaging system of the invention.

If the development process of FIG. 2 or FIG. 3 is used in combination with developing units using four color toners (developing agent) comprising yellow Y, cyan C, magenta M and black K, it is then possible to achieve a system capable of forming a full-color image.

One specific embodiment of the imaging system of the invention to which a negative charge dry toner is applied is now explained.

Figure 4:
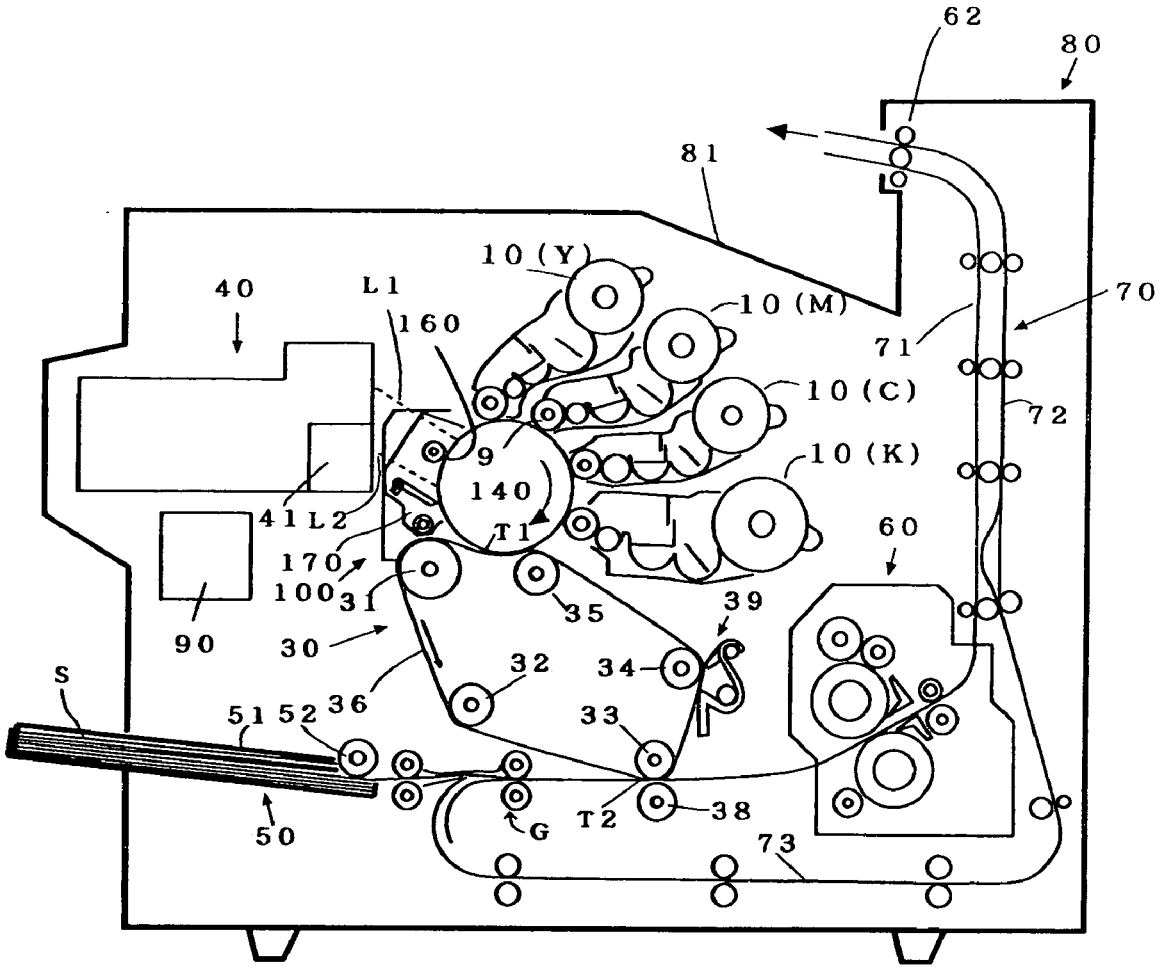
FIG. 4 is illustrative of yet another embodiment of the imaging system according to the invention.

FIG. 4 is illustrative of one specific embodiment of a four-cycle type full-color printer.

In FIG. 4, reference numeral 100 stands for an image carrier cartridge with a built-in image carrier unit. In this embodiment, the image carrier cartridge is provided in the form of a photosensitive member cartridge to which a photosensitive member and a developing unit are separately attached. An electrophotographic photosensitive member (latent image carrier) 140 is driven by means of driving means (not shown) in a direction indicated by an arrow. Around the photosensitive member 140 and along the direction of its rotation, there are positioned a charging roller 160 as charging means, developing units 10Y, 10M, 10C and 10K as developing means, an intermediate transfer assembly 30 and a cleaning means 170.

This embodiment of the invention may be installed as a cleaner-free imaging system from which the cleaning means 170 is removed.

The charging roller 160 comes in abutment with the outer periphery of the photosensitive member 140 for uniform charging of that outer periphery. The outer periphery of the uniformly charged photosensitive member 140 is selectively exposed to light, as shown at L1, in an exposure unit 40 depending on the desired image information, so that an electrostatic latent image is formed by this exposure L1 on the photosensitive member 140. In the developing assembly 10, the developing agent is given to the electrostatic latent image for development.

The developing assembly is made up of a yellow developing unit 10Y, a magenta developing unit 10M, a cyan developing unit 10C and a black developing unit 10K. The developing assembly is assembled such that the developing units 10Y, 10C, 10M and 10K are each capable of fluctuating and a development roller 9 in association with one of them is selectively engaged with the photosensitive member 140. The developer assembly 10 has a negatively charged toner on an associated development roller. In the developing assembly 10, a toner from any one of the yellow, magenta, cyan and black developing units 10Y, 10M, 10C and 10B is supplied to the surface of the photosensitive member 140 to develop an electrostatic latent image on the photosensitive member 140. The development roller 9 is formed of a hard roller, e.g., a metallic roller having a roughened surface. The toner image upon development is then transferred onto an intermediate transfer belt 36 over an intermediate transfer assembly 30. Cleaning means 170 comprises a cleaner blade for scraping off a toner T deposited onto the outer periphery of the photosensitive member 140, and a cleaning toner collector for receiving the toner scraped off by the cleaner blade.

The intermediate transfer assembly 30 comprises a driving roller 31, four follower rollers 32, 33, 34 and 35 and an intermediate transfer endless belt 36 engaged with these rollers. The driving roller 31 includes a gear (not shown) fixed at its end, which mates with a driving gear of the photosensitive member 140, whereby the driving roller 31 is rotationally driven at substantially the same peripheral speed as that of the photosensitive member 140, so that the intermediate transfer belt 36 is endlessly driven at substantially the same peripheral speed as that of the photosensitive member 140 in a direction indicated by an arrow.

The follower roller 35 is located at a position where the intermediate transfer belt 36 is engaged with the photosensitive member 140 under its own tension between the follower roller 35 and the driving roller 31, and at a portion of engagement of the photosensitive member 140 with the intermediate transfer belt 36, there is a primary transfer site T1. The follower roller 35 is located near to the primary transfer site T1 on an upstream side of the endless direction of the intermediate transfer belt.

The driving roller 31 is provided with an electrode roller (not shown) via the intermediate transfer belt 36, and via this electrode roller a primary transfer voltage is applied to an electrically conductive layer of the intermediate transfer belt 36. The follower roller 32 is a tension roller that biases the intermediate transfer belt 36 by biasing means (not shown) in its tensioning direction. The follower roller 33 is a backup roller that defines a secondary transfer site T2. A secondary transfer roller 38 is opposed to the backup roller 33 via the intermediate transfer belt 36. A secondary transfer voltage is applied to the secondary transfer roller so that a gap with respect to the intermediate transfer belt 36 is adjustable by means of a gap adjustment mechanism (not shown). The follower roller 34 is a backup roller for a belt cleaner 39. The belt cleaner 39 is provided such that a gap with respect to the intermediate transfer belt 36 is adjustable by means of a gap adjustment mechanism (not shown).

The intermediate transfer belt 36 is made up of a double-layer belt comprising an electrically conductive layer, and a resistance layer formed thereon and engaged with the photosensitive member 140. The conductive layer is formed on an insulating substrate composed of a synthetic resin, and receives the primary transfer voltage via the above electrode roller. It is noted that at the side edge of the belt, the resistance layer is removed in a belt form to bare a portion of the conductive layer, which portion comes in contact with the electrode roller.

While the intermediate transfer belt 34 is endlessly driven, a toner image on the photosensitive member 140 is transferred onto the intermediate transfer belt 36 at the primary transfer site T1, and the toner image transferred onto the intermediate transfer belt 34 is transferred at the secondary transfer site T2 onto a recording material S such as a sheet fed between the intermediate transfer belt 34 and the secondary transfer roller 38. The recording material S is fed from a sheet feeder 50 to the secondary transfer site T2 through a pair of gate rollers G at a given timing. Reference numeral 51 stands for a feed cassette and 52 a pickup roller.

After the toner image is fixed on the sheet at a fixing unit 60, the sheet is ejected through an ejection path 70 on a sheet receiver 81 provided on a housing 80 of the imaging system. It is noted that the imaging system includes two independent ejection sub-paths 71 and 72 that defines the ejection path 70, and the sheet passing through the fixing unit 60 is ejected through either one of the ejections sub-paths 71 and 72. It is also noted that the ejection sub-paths 71 and 72 define together a switchback path, so that when an image is formed on both sides of a sheet, the sheet, once inserted through the ejection sub-path 71 or 72, is fed back to the secondary transfer site T2 through a return roller 73.

The general operations of such an imaging system as described above are now explained.

(1) Upon transmission of image information from, e.g., a personal computer (not shown) to a control 90 of the image system, the photosensitive member 140, the respective rollers 9 of the developing assembly 10 and the intermediate transfer belt 36 are rotationally driven.

(2) The outer periphery of the photosensitive member 140 is uniformly charged by means of the charging roller 160.

(3) The uniformly charged outer periphery of the photosensitive member 140 is subjected to selective exposure L1 by the exposure unit 40 in association with image information regarding the first color (e.g., yellow), thereby forming an electrostatic latent image for yellow.

(4) Only the development roller of the developing unit 10Y for the first color (e.g., yellow) comes in contact with the photosensitive member 140, whereby the above electrostatic latent image is developed to form a yellow toner image of the first color on the photosensitive member 140.

(5) The primary transfer voltage opposite in polarity to the above toner is applied on the intermediate transfer belt 36, so that the toner image formed on the photosensitive member 140 is transferred at the primary transfer site T1 onto the intermediate transfer belt 36. At this time, the secondary transfer roller 38 and belt cleaner 39 are spaced away from the intermediate transfer belt 36.

(6) After removal of toner residues on the photosensitive member 140 by the cleaning means 170, the photosensitive member 140 is irradiated with erase light L2 from antistatic means 41 for elimination of static electricity.

(7) The above operations (2) to (6) are repeated if required. Specifically, the operations are repeated for the second, third and fourth colors in association with the above printing command, so that the toner images in association with the above printing command are formed on the intermediate transfer belt 36 while they are put one upon another.

(8) At a given timing, the recording material S is fed from the sheet feeder 50 and, just before or after the leading end of the recording material S arrives at the secondary transfer site T2, i.e., at a timing at which the toner images on the intermediate transfer belt 36 are transferred onto the desired position on the recording material S, the toner images on the intermediate transfer belt 36, i.e., a full-color image comprising toner images of four colors put one upon another are transferred by the secondary transfer roller 38 onto the recording material S. In the meantime, the belt cleaner 39 engages the intermediate transfer belt 36, so that after the secondary transfer, toner residues on the intermediate transfer belt 36 are removed.

(9) While the recording material S is passed through the fixing unit 60, the toner images on the recording material S are fixed, whereupon the recording maerial S is delivered toward a given position (toward the sheet receiver 81 in the case of one-side printing or toward the return roller 73 via the switchback-defining sub-path 71 or 72 in the case of double-side printing).

In the imaging system of the invention, it is acceptable that the development roller 9 and intermediate transfer medium 36 are in abutment with the photosensitive member 140 and development is carried out in the non-contact mode.

Figure 5:
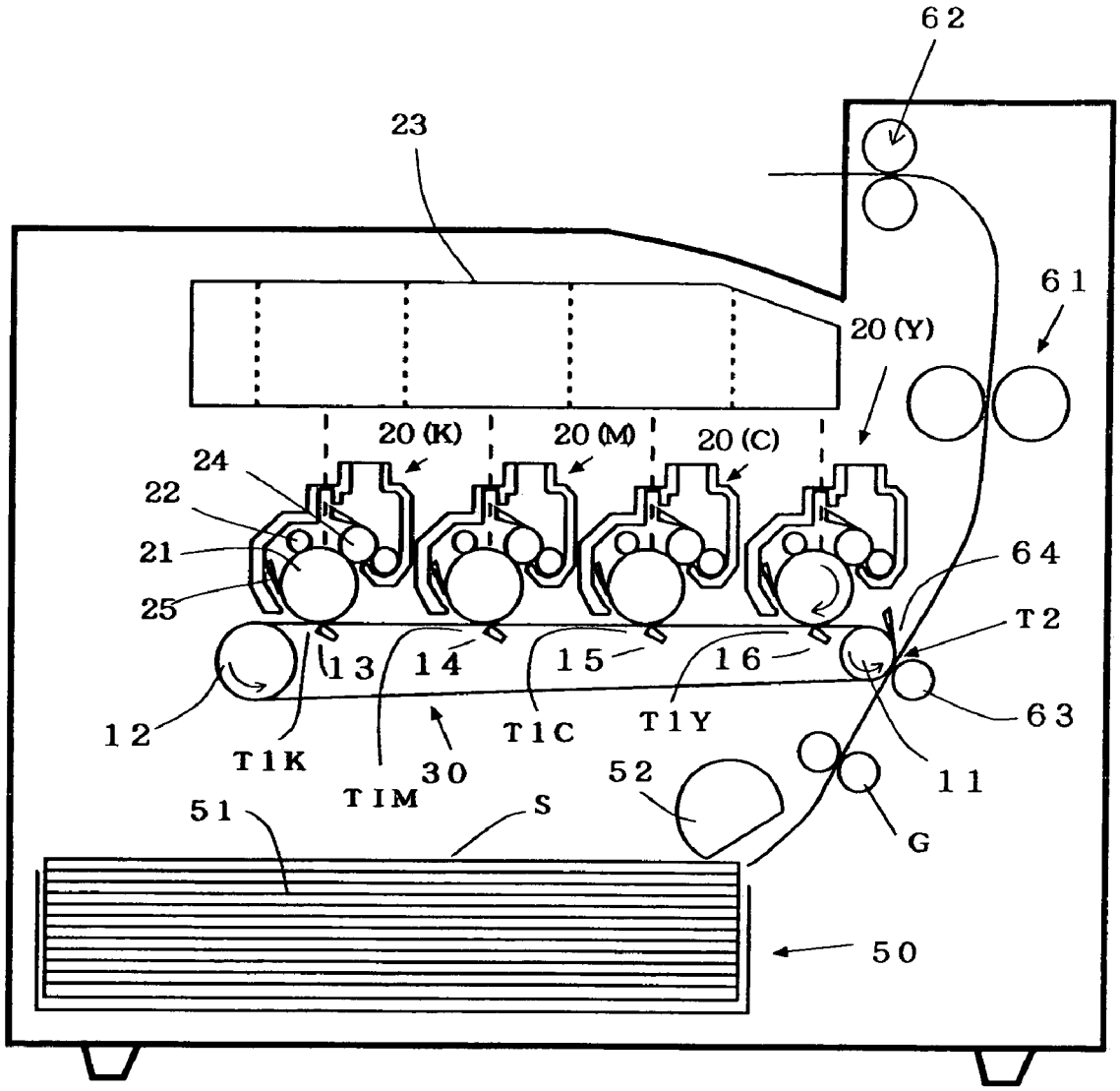
FIG. 5 is illustrative of a further embodiment of the imaging system according to the invention.

FIG. 5 is a front schematic of one specific embodiment of the tandem type full-color printer used herein. In this embodiment, a photosensitive member and a developing unit can be attached to the printer in the form of the same unit, i.e., a process cartridge, and development may be carried out in not only the contact mode as shown, but also in the non-contact mode.

The imaging system comprises an intermediate transfer belt 30 adapted to be endlessly driven in a direction indicated by an arrow (counterclockwise) with only two rollers, a driving roller 11 and a follower roller 12 in engagement therewith, and four monochromatic toner image-forming means 20Y, 20C, 20M and 20K that are located with respect to the intermediate transfer belt 30. Toner images formed by the four monochromatic toner image-forming means 20 are successively primarily transferred onto the intermediate transfer belt 30 by individual transfer means 13, 14, 15 and 16. The associated primary transfer sites are indicated at T1Y, T1C, T1M and T1K, respectively.

As described above, the monochromatic toner image-forming means 20 comprises 20Y for yellow, 20M for magenta, 20C for cyan and 20K for black. The monochromatic toner image-forming means 20Y, 20M, 20C and 20K are each made up of a photosensitive member 21 having a photosensitive layer on its outer periphery, a charging roller 22 as charging means for charging uniformly the outer periphery of the photosensitive member 21, an exposure means 23 for subjecting the outer periphery of the photosensitive member 21 uniformly charged by the charging roller 22 to selective exposure to form an electrostatic latent image, a development roller 24 as developing means for imparting a developing agent or a toner to the electrostatic latent image formed by the exposure means 23 to form a visible image (toner image), and a cleaning blade 25 as cleaning means for removal of toner residues on the surface of the photosensitive member 21 after transfer of the toner image developed by the development roller 24 on an intermediate transfer belt 30 for the primary transfer.

These monochromatic toner image-forming means 20Y, 20C, 20M and 20K are located on the slack side of the intermediate transfer belt 30. The toner images are successively primarily transferred onto the intermediate transfer belt 30 on which they are successively put one upon another into a full-color toner image. Then, this full-color toner image is secondarily transferred at the secondary transfer site T2 onto a recording material S such as a sheet, which is then passed through a pair of fixing rollers 61 for fixation of the image on the recording sheet S. Then, the recording material is ejected between a pair of ejection rollers 62 to a given site, i.e., an output tray (not shown). Reference numeral 51 is indicative of a feed cassette having a stack of recording materials S, 52 a pickup roller for feeding the recording materials S one by one from the feed cassette 51, and G a pair of gate rollers for controlling a feed timing of the recording materials S to the secondary transfer site T2.

Reference numeral 63 is indicative of a secondary transfer roller as secondary transfer means for defining the secondary transfer site T2 between it and the intermediate transfer belt 30, and 64 a cleaning blade as cleaning means for removal of toner remnants on the surface of the intermediate transfer belt 30 after the secondary transfer. After the secondary transfer, the cleaning blade 64 is in abutment with a portion of the intermediate transfer belt 30, which engages the driving roller 11 rather than the follower roller 12.

Figure 6:
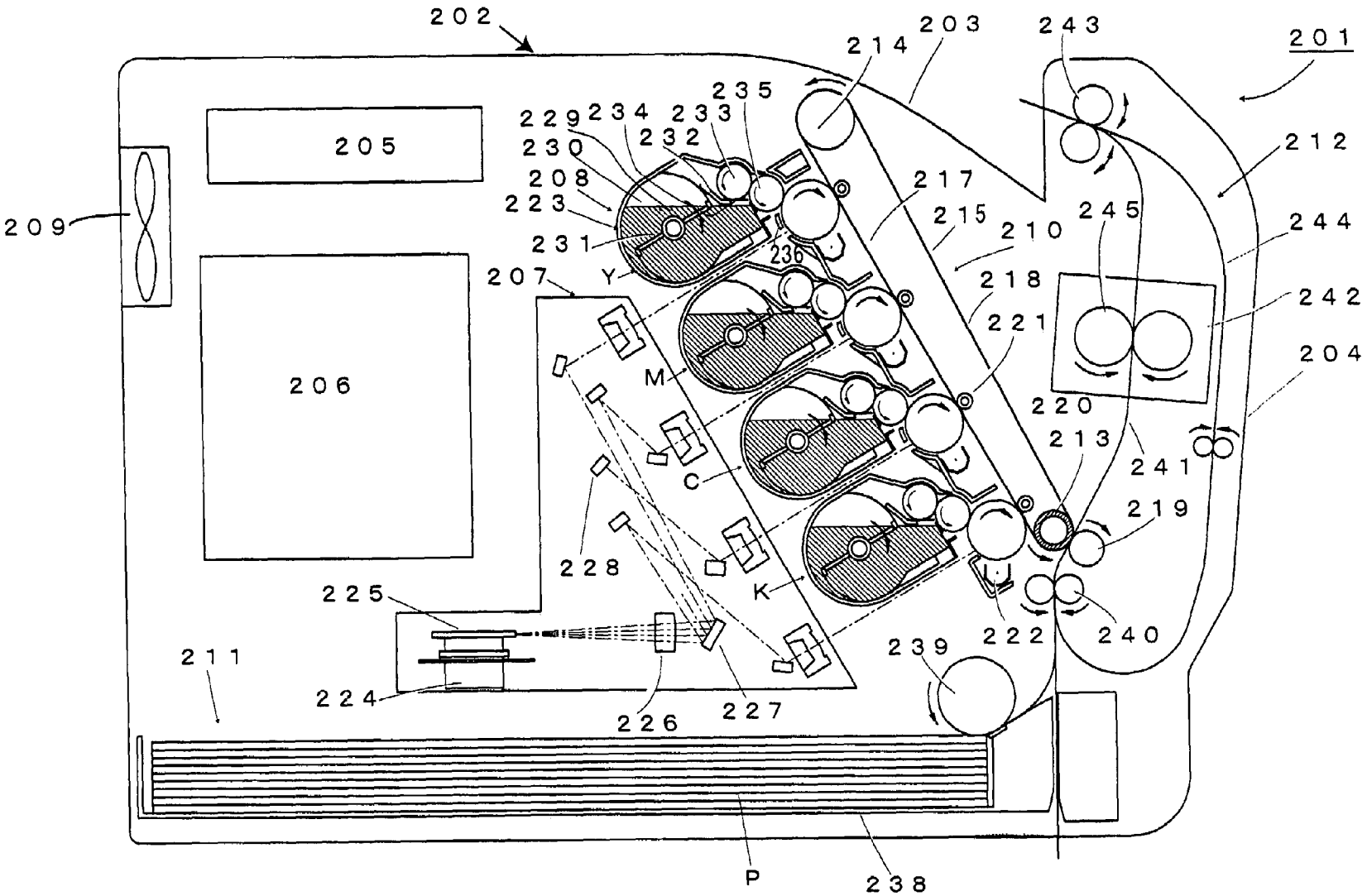
FIG. 6 is illustrative of a further embodiment of the imaging system according to the invention.

FIG. 6 is a front schematic of another embodiment of the tandem type full-color printer according to the invention.

In the embodiment of FIG. 6, an imaging system 201 has no cleaning means, and comprises a housing 202, an output tray 203 mounted on the housing 202 and a door 204 hinged on the front face of the housing 202. Within the housing 202, there are received a control unit 205, a power supply unit 206, an exposure unit 207, an imaging unit assembly 208, an exhaust fan 209, a transfer unit 210 and a sheet feeder unit 211, and within the door 204 there is provided a sheet delivery unit 212. Each unit is adapted to be attachable to or detachable from the system, so that it can be removed in its entirety for maintenance operations inclusive of repair and replacement.

The transfer unit 210 comprises a driving roller 213 located at a lower portion of the housing and rotationally driven by a driving source (not shown), a follower roller 214 located obliquely upward of the driving roller 213 and an intermediate transfer belt 215 engaged between these two rollers alone and endlessly driven in a direction indicated by an arrow (counterclockwise), wherein the follower roller 214 and intermediate transfer belt 215 are positioned obliquely with respect to the driving roller 213 on the left side of FIG. 6. While the intermediate transfer belt 215 is driven, therefore, the tight side (pulled by the driving roller 213) 217 of the belt is positioned inside and the slack side 218 of the belt is positioned outside.

The driving roller 213 also serves as a backup roller for the secondary transfer roller 219 to be referred to later. On the peripheral surface of the driving roller 213 there is provided a rubber layer having a thickness of about 3 mm and a volume resistivity of up to $1\times10^5$ Ω·cm, which rubber layer is then grounded via a metallic shaft to define an electrically conductive path for the secondary transfer bias voltage applied via the secondary transfer roller 219. Thus, the high friction, shock-absorbing rubber layer provided around the driving roller 213 makes it difficult to transmit impacts upon entrance of a recording material in a secondary transfer site to the intermediate transfer belt 215, preventing degradation in image quality.

In the invention, the diameter of the driving roller 213 is smaller than that of the follower roller 214, so that after the secondary transfer, a recording material can peel off easily by virtue of its own elastic force.

A primary transfer member 221 is in abutment with the back surface of the intermediate transfer belt 215 in opposition to an image carrier 220 in each of four monochromatic imaging units Y, M, C and K that form together the imaging unit assembly 208 to be described later, and a transfer bias is applied to the primary transfer member 221.

The imaging unit assembly 208 comprises a plurality of (four in this embodiment) monochromatic imaging units Y for yellow, M for magenta, C for cyan and K for black that are to form images of different colors, wherein each monochromatic imaging unit Y, M, C, K comprises an image carrier 220 having an organic photosensitive layer and an inorganic photosensitive layer, a charging means 222 located around the image carrier 220 and comprising a corona charger or a charging roller, and a developing means 223.

The image carrier 220 in each monochromatic imaging unit Y, M, C, K is in abutment with the tight side 217 of the intermediate transfer belt 215 and, consequently, each imaging unit Y, M, C, K, too, is located obliquely with respect to the driving roller 213 on the left side of FIG. 6. The image carrier 220 is rotationally driven in an opposite direction to the intermediate transfer belt 215, as indicated by an arrow.

The exposure unit 207 is located below the imaging unit assembly 208 and obliquely with respect to the same, and includes therein a polygon mirror motor 224, a polygon mirror 225, an f-θ lens 226, a reflecting mirror 227 and a turn-back mirror 228. An image signal corresponding to each color, emitted out of the polygon mirror 225 and modulated on the basis of a common data clock frequency, is directed to the image carrier 220 in each monochromatic imaging unit Y, M, C, K via the f-θ lens 226, reflecting mirror 227 and turn-back mirror 228, thereby forming a latent image. It is here noted that the optical paths from the respective monochromatic imaging units Y, M, C, K to the image carrier 220 are controlled to substantially the same length by the action of the turn-back mirrors 228.

The developing means 223 is now explained typically with reference to the monochromatic imaging unit Y. A downwardly inclining toner receiver 229 is provided because, in the instant embodiment, each monochromatic imaging unit Y, M, C, K is located obliquely on the left side of FIG. 6.

More specifically, the developing means 223 is built up of a toner storage 229 for storing a toner, a toner reservoir 230 (as hatched in FIG. 6) provided in the toner storage 229, a toner stirring member 231 located within the toner reservoir 230, a partition member 232 provided in an upper portion of the toner reservoir 230, a toner feed roller 233 located above the partition member 232, a charging blade 234 located at the partition member 232 in abutment with the toner feed roller 233, a development roller 235 located proximately to the toner feed roller 233 and image carrier 220, and a regulated blade 236 in abutment with the development roller 235.

The development roller 235 and toner feed roller 233 are rotationally driven in the opposite direction to the direction of rotation of the image carrier 220, and the stirring member 231 is rotationally driven in the opposite direction to the direction of rotation of the feed roller 233. In the toner reservoir 230, the toner being stirred by the stirring member 231 is guided up along the upper surface of the partition member 232 to the toner feed roller 233. The thus fed toner comes in frictional contact with the charging blade 234 formed of a flexible member, so that the toner can be supplied onto the surface of the development roller 235 by virtue of mechanical adherence force acting on the pit-and-projection pattern on the surface of the feed roller 233 and frictional charge adherence force.

The toner supplied to the development roller 235 is controlled to the desired thinness by the regulated blade 236. The thin toner layer is then delivered to the image carrier 220 where an electrostatic latent image thereon is developed at a developing area where the development roller 235 comes close to the image carrier 220.

For the formation of images, the feed unit 211 comprises a feed cassette 238 having a stack of recording materials S therein and a pickup roller 239 for feeding the recording materials S one by one from the feed cassette 238.

The paper delivery unit 212 comprises a pair of gate rollers 240 for controlling the feed timing of feeding a recording material S to the secondary transfer site (with one roller located on the housing side 202), a secondary transfer roller 219 as secondary transfer means in engagement with the driving roller 213 and intermediate transfer belt 215, a main recording material delivery path 241, a fixing means 242, a pair of ejection rollers 243 and a double-side-printing delivery path 244. The fixing means 242 comprises a pair of rotatable fixing rollers 245 at least one of which has a built-in heating element such as a halogen heater, and an engaging means that biases at least one roller of the fixing rollers 245 against the other roller thereby engaging the secondarily transferred secondary image with the recording material S. The secondary image secondarily transferred onto the recording material is fixed to the recording material at a nip between the fixing rollers 245.

According to the invention wherein the intermediate transfer belt 215 is positioned such that it inclines on the left side of FIG. 6, there is created on the right side a space wide enough to receive the fixing means 242. This is helpful for preventing the heat generated at the fixing means 242 from having adverse influence on the exposure unit 207, intermediate transfer belt 215 and each monochromatic imaging unit Y, M, C, K, all located on the left side.

A measuring cell for the measurement of work function is now explained with reference to FIGS. 7(A) and 7(B).

As shown in a plan view of FIG. 7(A) and in a side view of FIG. 7(B), a sample-measuring cell C1 is a stainless disk having a diameter of 13 mm and a height of 5 mm, which is provided at its center with a toner-receiving recess C2 having a diameter of 10 mm and a depth of 1 mm. Using a weighing spoon, a toner is placed in the recess in the cell without compaction. For measurement, the toner is then flattened on the surface using a knife-edge.

The measuring cell with the toner filled therein is fixed at a predetermined position on a sample table, and the work function of the toner is measured at an irradiation dose of 500 nW, an irradiation area of 4 mm square and an energy scanning range of 4.2 to 6.2 eV.

Upon the measurement of the work function, the normalized electron yield is 8 or greater at a measurement dose of 500 nW.

Figure 8:
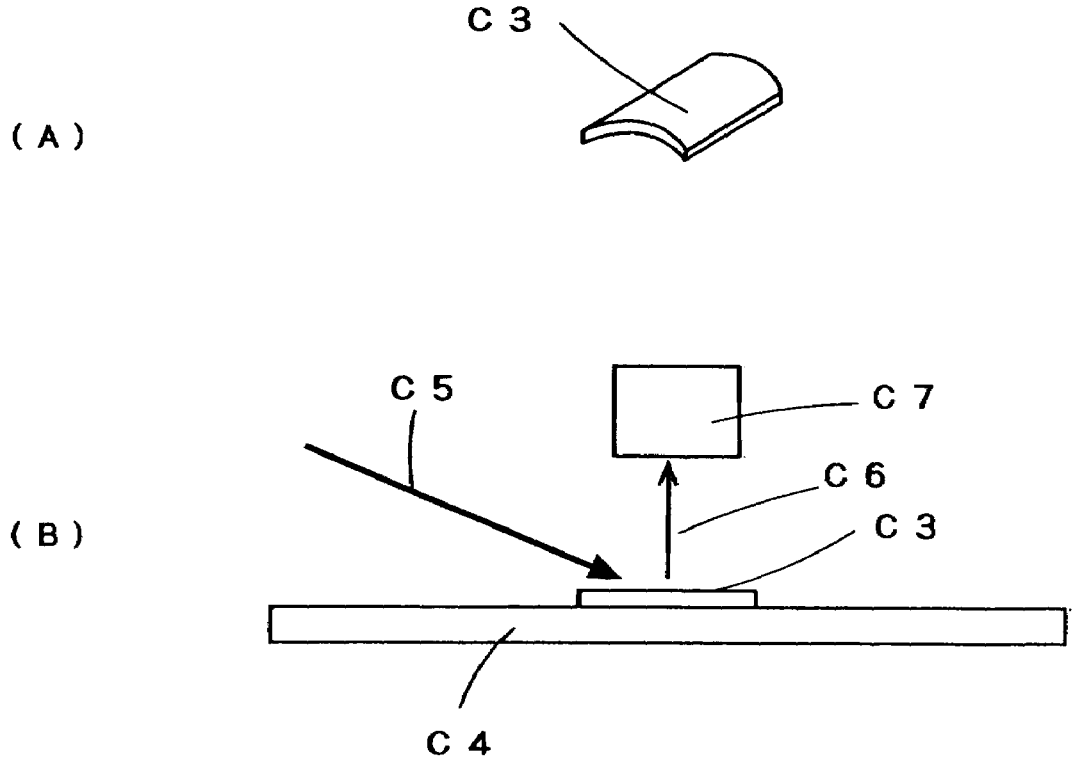
FIGS. 8(A) and 8(B) are illustrative of another measurement of work functions.

FIGS. 8(A) and 8(B) are illustrative of how to measure the work function of a sample having another shape.

Specifically, FIGS. 8(A) and 8(B) are illustrative of how to measure the work function of a cylindrical member sample such as an intermediate transfer medium or latent image carrier sample. As shown in FIG. 8(A), the sample is first cut at a width of 1 to 1.5 cm, and then laterally cut along its ridgeline into a measuring sample piece C3. Then, as shown in FIG. 8(B), the sample piece C3 is fixed at a predetermined position on a sample table C4 in such a way that the surface of the sample to be irradiated is parallel with the irradiation direction of measuring light C5, so that emitted photoelectrons C6 can be sensed by a sensor C7, i.e., a multiplier phototube with good efficiency.

For the toner used herein, a toner obtained by pulverization or a toner obtained by polymerization may be used; however, it is preferable to make use of the toner obtained by polymerization because of having satisfactory circularity.

The toner by pulverization is obtained by uniformly mixing a resin binder containing at least a pigment with additives such as a release agent and a charge control agent in a Henschel mixer or the like, subjecting the mixture to hot kneading through a twin-screw extruder followed by cooling, and classifying the melt upon crush-pulverization, optionally with deposition of external additive particles thereto.

For the binder resin, synthetic resins used as toner resins are usable. For instance, use may be made of styrene resins or homopolymers or copolymers containing styrene or styrene substituents such as polystyrene, poly-α-methylstyrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylic ester copolymers, styrene-methacrylic ester copolymers, styrene-acrylic ester-methacrylic ester copolymers, styrene-α-chloromethyl acrylate copolymers, styrene-acrylonitrile-acrylic ester copolymers and styrene-vinyl methyl ether copolymers, polyester resins, epoxy resins, urethane-modified epoxy resins, silicone-modified epoxy resins, vinyl chloride resins, rosin-modified maleic acid resins, phenyl resins, polyethylene, polypropylene, ionomer resins, polyurethane resins, silicone resins, keton resins, ethyle-ethyl acrylate copolymers, xylene resins, polyvinyl butyral resins, terpene resins, phenol resins, and aliphatic or alicyclic hydrocarbon resins. These resins may be used alone or in combination of two or more.

Particularly preferable for the invention are styrene-acrylic ester resins, styrene-methacrylic ester resins, and polyester resins. The binder resin used herein should preferably have a glass transition temperature in the range of 50 to 75° C. and a flow softening temperature in the range of 100 to 150° C.

The coloring agent used herein includes those available for toner purposes. For instance, use may be made of carbon black, lamp black, magnetite, titanium black, chrome yellow, ultramarine blue, aniline blue, phthalocyanine blue, phthalocyanine green, Hansa Yellow G, Rhodamine 6G, Chalco Oil Blue, Quinacridone, Benzidine Yellow, Rose Bengale, Malachite Green Lake, Quinoline Yellow, CI Pigment Red 48:1, CI Pigment Red 122, CI Pigment Red 57:1, CI Pigment Red 122, CI Pigment Red 184, CI Pigment Yellow 12, CI Pigment Yellow 17, CI Pigment Yellow 97, CI Pigment Yellow 180, CI Solvent Yellow 162, CI Pigment Blue 5:1 and CI Pigment Blue 15:3. These dyes and pigments may be used alone or in combination of two or more.

The release agent used here includes those available so far for toner purposes. For instance, use may be made of paraffin wax, microwax, microcrystalline wax, candelilla wax, carnauba wax, rice wax, montan wax, polyethylene wax, polypropylene wax, oxidized polyethylene wax and oxidized polypropylene wax, among which polyethylene wax, polypropylene wax, carnauba wax and ester wax are preferred.

The charge control agent used herein includes those available so far for toner purposes. For instance, use may be made of oil black, oil black BY, Bontron S-22 and S-34 (made by Orient Chemical Co., Ltd.), salicylic acid metal complexes E-81 and E-84 (Orient Chemical Co., Ltd.), thioindigo pigments, sulfonylamine derivatives of copper phthalocyanine, Spiron Black TRH (Hodogaya Chemical Co., Ltd.), calixarene compounds, organoboron compounds, fluorine-containing quaternary ammonium salt compounds, monoazo metal complexes, aromatic hydroxcarboxylic acid metal complexes, aromatic dicarboxylic acid metal complexes and polysaccharides. In particular, colorless or white toners are preferred for color toner purposes.

In the toner by pulverization, the coloring agent is used in an amount of 0.5 to 15 parts by weight and preferably 1 to 10 parts by weight, the release agent in an amount of 1 to 10 parts by weight and preferably 2.5 to 8 parts by weight, and the charge control agent in an amount of 0.1 to 7 parts by weight and preferably 0.5 to 5 parts by weight, all per 100 parts by weight of binder resin.

According to the invention, the toner by pulverization should preferably be configured as spheres for the purpose of improving transfer efficiency. To this end, toners having a circularity enhanced to 0.93 may be obtained using a machine capable of obtaining relatively round particles by pulverization, e.g., a turbo mill (made by Turbomill Heavy Industries, Ltd.) known as a mechanical pulverizer. Alternatively, the circularity of toner particles obtained by pulverization may be enhanced to as high as 1.00 by means of a hot air sphere making machine (made by Nippon Pneumatic Industries, Ltd.).

It is here noted that the "average particle diameter" and "circularity" of toner particles in the present disclosure are understood to refer to values measured by means of a particle image analyzer (FPIA2100 made by Sysmex Co., Ltd.).

The toner by polymerization, for instance, includes those obtained by suspension polymerization, emulsion polymerization, and dispersion polymerization. For suspension polymerization, a monomer composition is first provided, in which a polymerizable monomer, a coloring pigment and a release agent are dissolved or dispersed, if required, together with a dye, a polymerization initiator, a crosslinking agent, a charge control agent and other additives. Then, the monomer composition is added under agitation in an aqueous phase containing a suspension stabilizer (a water-soluble polymer or an inorganic material less soluble in water) for granulation and polymerization, thereby obtaining colored polymerized particles having the desired particle size.

For emulsion polymerization, polymerization is first carried out while a monomer and a release agent are dispersed in water, if required, together with a polymerization initiator, an emulsifier (surfactant) and so on. Then, a coloring agent, a charge control agent, a flocculating agent (electrolyte), etc. are added to the polymerization product in the process of flocculation, so that colored toner particles having the desired particle size can be obtained.

The coloring agent, release agent and charge control agent used for the toner preparation by polymerization may be the same as mentioned in connection with the toner by pulverization.

The polymerizable monomer component used herein may be any known vinylic monomer that, for instance, includes styrene, o-methylstyrene, m-methylstyrene, p-methylstyrene, α-methylstyrene, p-methoxystyrene, p-ethylstyrene, vinyl toluene, 2,4-dimethylstyrene, p-n-butylstyrene, p-phenylstyrene, p-chlorostyrene, divinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethylhexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethylhexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthallic anhydride, ethylene, propylene, butylene, isobutylene, vinyl chloride, vinylidene chloride, vinyl bromide, vinyl fluoride, vinyl acetate, propylenic acid vinyl, acrylonitrile, methacrylonitrile, vinyl methyl ether, vinyl ethyl ether, vinyl ketone, vinyl hexyl ketone and vinyl naphthalene. It is noted that some fluorine-containing monomers, e.g., 2,2,2-trifluoroethyl acrylate, 2,2,3,3-tetrafluoropropyl acrylate, vinylidene fluoride, ethylene trifluoride, tetrafluoroethylene and trifluoropropylene may be used because fluorine atoms are effective for charge control.

The emulsifier (surfactant) used herein, for instance, includes sodium dodecylbenzene sulfate, sodium tetradecyl sulfate, sodium pentadeceyl sulfate, sodium octyl sulfate, sodium oleate, sodium laurate, potassium stearate, calcium oleate, dodecylammonium chloride, dodecylammonium bormide, dodecyltrimethylammonium bromide, dodecylpyridinium chloride, hexydecyltrimethylammonium bromide, dodecylpolyoxyethylene ether, hexydecylpolyoxy-ethylene ether, laurylpolyoxyethylene ether, and sorbitan monooleate polyoxyethylene ether.

The polymerization initiator used herein, for instance, includes potassium persulfate, sodium persulfate, ammonium persulfate, hydrogen peroxide, 4,4'-azobiscyanovaleric acid, t-butyl hydroperoxide, benzoyl peroxide and 2,2'-azobis-isobutylonitrile.

The flocculating agent (electrolyte) used herein, for instance, includes sodium chloride, potassium chloride, lithium chloride, magnesium chloride, calcium chloride, sodium sulfate, potassium sulfate, lithium sulfate, magnesium sulfate, calcium sulfate, zinc sulfate, aluminum sulfate and iron sulfate.

Referring here to how to control the circularity of the toner by polymerization, the circularity of the toner by emulsion polymerization can freely be varied between 0.94 and 1.00 by control of temperature and time in the process of flocculation of secondary particles. With the suspension polymerization capable of obtaining toner particles of true sphericity, a circularity of as high as 0.98 to 1.00 is achievable. As a toner is heated at a temperature higher than its Tg for deformation, the circularity can freely be controlled to as high as 0.94 to 0.98.

The number base average diameter per toner should be preferably up to 9 μm, and more preferably between 8 μm and 4.5 μm. With a toner of greater than 9 μm, the reproducibility of the resolution of a latent image, even when formed at a resolution of 1,200 dpi or higher, is lower than could be achieved with a toner having a smaller particle diameter. A toner of less than 4.5 μm is not preferred because its covering capability becomes low, and the amount of the external additives used to enhance fluidity increases, rendering fixation capability likely to drop.

The external additives are now explained. The toner particle of the invention contains as an external additive a surface-modified silica particle modified by an oxide or hydroxide of at least one metal selected from titanium, zirconium and aluminum in an amount of, in weight ratio, up to 1.5 times as large as silica particle.

For other additives, a variety of inorganic and organic toner flowability improvers may be used. For instance, use may be made of fine particle forms of positively chargeable silica, titanium dioxide, alumina, zinc oxide, magnesium fluoride, silicon carbide, boron carbide, titanium carbide, zirconium carbide, boron nitride, titanium nitride, zirconium nitride, zirconium oxide, magnetite, molybdenum disulfide, aluminum stearate, magnesium stearate, zinc stearate, calcium stearate, a metal salt of titanic acid such as strontium titanate, and a metal salt of silicon. These fine particles should preferably be used after hydrophobic treatments with a silane coupling agent, a titanium coupling agent, a higher fatty acid, silicone oil or the like. For this purpose, a fine particle form of resins such as acrylic resins, styrene resins and fluororesins may be used as well. The flowability improvers may be used alone or in admixture in an amount of preferably 0.1 to 5 parts by weight and more preferably 0.5 to 4.0 parts by weight per 100 parts by weight of toner.

For the silica particles, silica particles prepared from halides, etc. of silicon by dry processes or silica particles prepared by wet processes wherein they are precipitated from silicon compounds in liquids may be used.

The primary silica particles should preferably have an average particle diameter between 7 nm and 40 nm, and especially between 10 nm and 30 nm. Primary silica particles having an average particle diameter of less than 7 nm are likely to bury in a matrix toner particle as well as to become negatively overcharged. Primary silica particles of greater than 40 nm are less effective for imparting flowability to a matrix toner particle and render it difficult to negatively and uniformly charge the toner. As a result, the amount of oppositely or positively charged toner particles tends to increase.

In the invention, two types of silica having different number base average diameter distributions should preferably be used as silica particles. The incorporation of an external additive having a large particle diameter ensures prevention of the external additive from burying in the toner particles whereas the incorporation of an external additive having a small particle diameter ensures preferable flowability.

Specifically, it is preferable that one type of silica should have a number base primary particle diameter between 5 nm and 20 nm and especially between 7 nm and 16 nm, and the other type should have a number base primary particle diameter between 30 nm and 50 nm and especially between 30 nm and 40 nm.

It is noted that the particle diameter of the external additives used herein is determined by observation of an electron microscope image, and that the average particle diameter is defined by the number base average particle diameter.

The silica particles used as the external additives in the invention should preferably be used after hydrophobic treatments with a silane coupling agent, a titanium coupling agent, a higher fatty acid, silicone oil, etc. Exemplary agents for such treatments are dimethyldichlorosilane, octyltrimethoxysilane, hexamethyldisilazane, silicone oil, octyltrichlorosilane, decyl-trichlorosilane, nonyl-trichlorosilane, (4-isopropylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, (4-t-butylphenyl)-octyl-dichlorosilane, didecenyl-dichlorosilane, dinonenyl-dichlorosilane, di-2-ethylehexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, and (4-isopropylphenyl)-diethyl-chlorosilane.

It is also preferable that the silica particles are used in combination with a given amount of silica modified on its surface by a metal compound. Exemplary surface modified silica includes a silica particle having a specific surface area of 50 to 400 $m^2/g$ and coated with an hydroxide or oxide of at least one metal selected from titanium, tin, zirconium and aluminum.

This silica, used in an amount of 1 to 30 parts by weight per 100 parts by weight of silica particles, may be obtained by providing a slurry wherein silica is coated with the hydroxide or oxide, further coating the thus coated silica with an alkoxysilane in an amount of 3 to 50 parts by weight on the basis of solid matter in the slurry, and then neutralizing the silica with an alkali, followed by filtration, washing, drying and pulverization. The fine silica particle used for the surface modified silica may have been obtained by any of wet or dry processes.

The silica particle may be modified on its surface with an aqueous solution containing at least one of titanium, tin, zirconium and aluminum, for instance, titanium sulfate, titanium tetrachloride, tin chloride, stannous sulfate, zirconium oxychloride, zirconium sulfate, zirconium nitrate, aluminum sulfate and sodium aluminate.

The surface modification of the silica particle with the metal hydroxide or oxide may be achieved by treating a silica-particle slurry with an aqueous solution of the metal compound. The treatment temperature should preferably be in the range of 20 to 90° C.

Then, the silica particle is coated with an alkoxysilane for hydrophobic treatment. The hydrophobic treatment is achieved by regulating the pH of the slurry to 2 to 6 and preferably 3 to 6. Then, at least one alkoxysilane is added to the slurry in an amount of 30 to 50 parts by weight per 100 parts by weight of fine silica particles at a slurry temperature regulated to 20 to 100° C. and preferably 30 to 70° C., at which hydrolysis and condensation reactions take place.

After the addition of the alkoxysilane, the condensation reaction should preferably be promoted by regulation of pH to 4 to 9 and preferably 5 to 7 upon stirring of the slurry. For pH regulation, sodium hydroxide, potassium hydroxide, sodium carbonate, ammonia water, ammonia gas, etc. may be used. With such treatment, uniformly hydrophobic, stable fine particles are obtainable.

Then, the slurry is filtrated, washed with water, and dried so that the surface treated fine silica particles can be obtained.

The drying temperature is 100 to 190° C., and preferably 110 to 170° C. A drying temperature of below 100° C. is not preferable because drying efficiency becomes worse with a hydrophobicity drop. A drying temperature of higher than 190° C. is again not preferred because of discoloration and a hydrophobicity drop due to thermal decomposition of hydrocarbon groups.

The hydrophobic treatment may be such that after the addition of the alkoxysilane to the surface modified silica particle, the silica particle is coated with the alkoxysilane in a Henschel mixer or the like.

In the invention, these external additives should preferably be used in an amount of 0.05 to 2 parts by weight per 100 parts by weight of matrix toner particles.

In an amount of less than 0.05 part by weight, the external additives have no effect on flowability and prevention of overcharging whereas in an amount of greater than 2 parts by weight, the amount of negative charges decreases simultaneously with an increase in the amount of oppositely or positively charged toner, resulting in fogging and an increase in the amount of back transferred toner.

The difference in transfer efficiency due to the order of toner development according to the invention is believed to arise for the following reasons.

Figure 9:
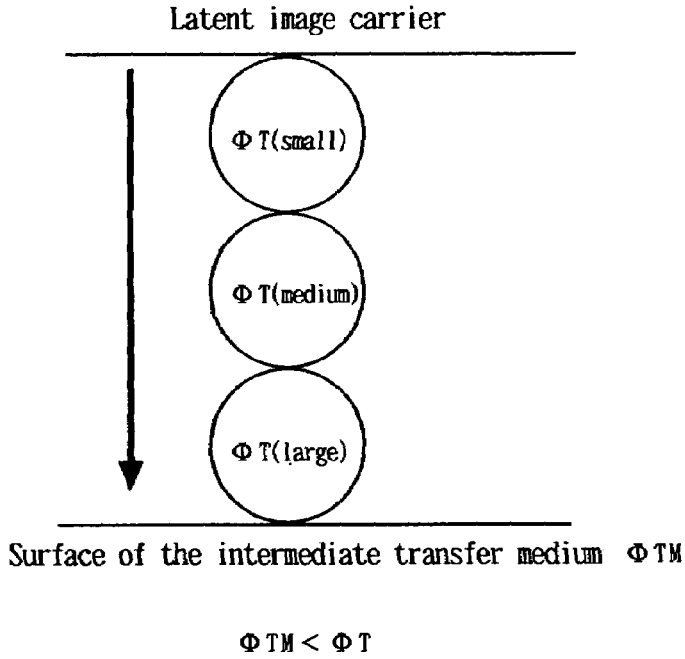
FIGS. 9(A), 9(B) and 9(C) are illustrative of toners put one upon another on the intermediate transfer medium according to the invention.
Figure 9:
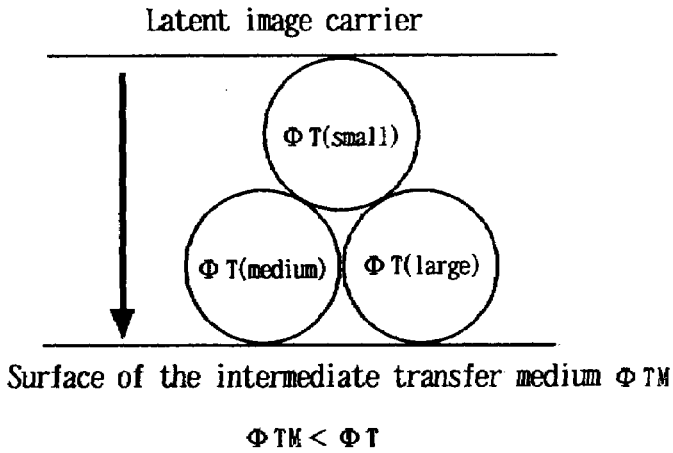
Figure 9:
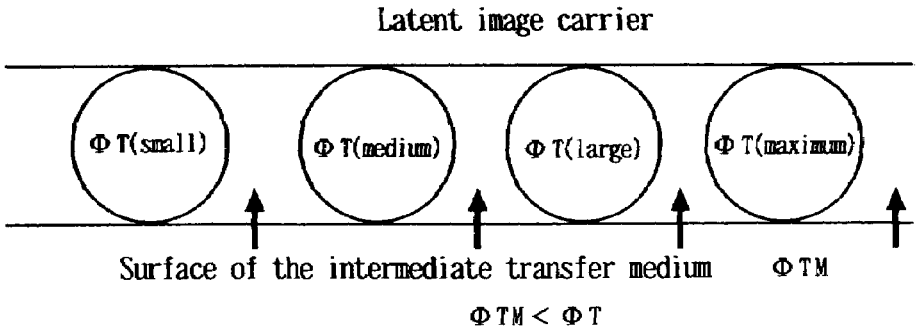

FIGS. 9(A), 9(B) and 9(C) are illustrative of toners put on the intermediate transfer medium according to the invention.

FIG. 9(A) is illustrative of an example of transfer of an image upon toners of two or more colors put one upon another. The toners are transferred onto the intermediate transfer medium in descending work function order for electrostatic deposition thereon.

Electrons (charges) migrate in a direction indicated by an arrow and charges on the uppermost toner portion become low, so that upon transfer at a constant voltage, the electrons (charges) flow in the same direction as the direction of transfer. This would contribute to transfer efficiency improvements.

FIG. 9(B) is illustrative of an example of transfer of a halftone image wherein toners are adjacent to each other. Development and transfer occur in descending work function order for electrostatic deposition of the toners onto the intermediate transfer belt. Again, electrons (charges) migrate in a direction indicated by an arrow and charges on the uppermost toner portion become low, so that upon transfer at a constant voltage, the electrons (charges) flow in the same direction as the direction of transfer. This would contribute to transfer efficiency improvements.

FIG. 9(C) is illustrative of an exemplary monochromatic line image, where toners are electrostatically deposited onto the intermediate transfer medium. Electrons (charges) migrate from the intermediate transfer medium to turn the charges on the toners negative. This would contribute to prevention of a back transferred toner because the amount of negative charges may increase but they by no means become positive.

Figure 10:
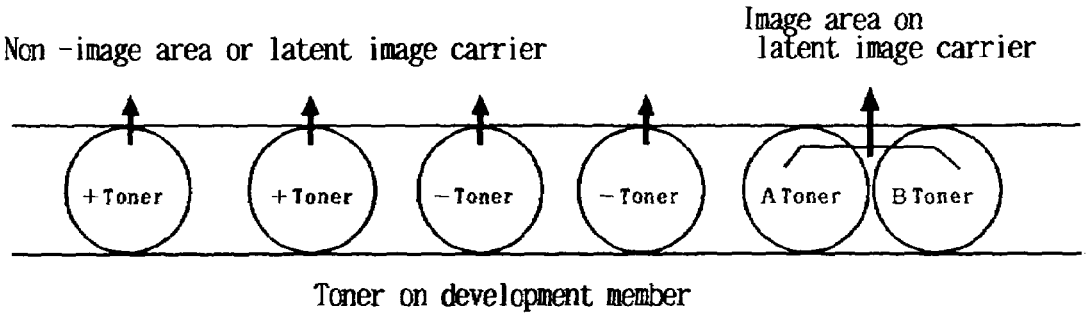
FIGS. 10(*a*), 10(*b*) and 10(*c*) are illustrative of the behavior of a positive charged toner responsible for fogging toner and back transferred toner.
Figure 10:
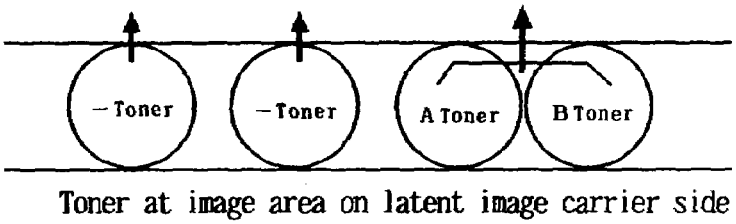
Figure 10:
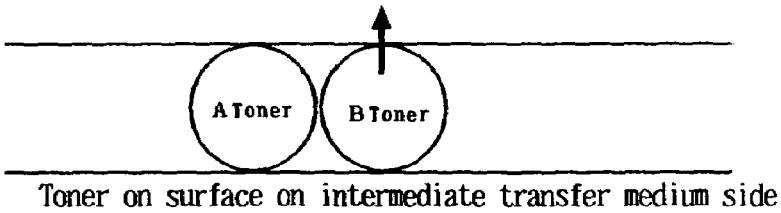

FIGS. 10(A), 10(B) and 10(C) are illustrative of the behavior of a positively charged toner responsible for a fogging toner and a back transferred toner.

FIGS. 10(A), 10(B) and 10(C) are now explained with reference to a specific embodiment wherein the surface potential of a latent image carrier is set at a non-image dark potential of −600 V and an image light potential of −80 V and the bias potential is set at −300 V.

FIG. 10(A) is illustrative of a specific state of the charge polarity of a fogging toner and a reversely developed toner on the latent image carrier. As can be seen from the behaviors of toners on a developing member, a + toner in a toner layer, which is opposite in potential polarity to the latent image carrier, is deposited on a non-image area, providing a so-called fogging toner, and a toner having the same polarity is reversely developed at an image area, forming a toner image. In some cases, a strongly negatively charged A toner and a weakly positively charged B toner are reversely developed in a pair form at the image area.

In FIG. 10(A), an arrow is indicative of how the toner migrates to the image and non-image areas on the latent image carrier during development. The B toner migrating onto the latent image carrier, as shown in FIG. 10(A), causes a back transferred toner, as shown in FIGS. 10(B) and 10(C).

As shown in FIG. 10(B), the reversely developed toner at the image area on the latent image carrier, i.e., the negatively charged toner is transferred onto the intermediate transfer medium upon application of a bias voltage having an opposite polarity thereto, as indicated by an arrow. At this time, the strongly negatively charged A toner and weakly positively charged B toner, too, are transferred in a pair form, as described above.

As shown in FIG. 10(C), in the toners transferred onto the intermediate transfer medium in the next step, the B toner transferred in a toner pair form is positively charged, so that it is attracted under electrostatic attractive force to the −600 V voltage of the non-image area at the latent image carrier in the next step, resulting in a back transferred toner with mixing of colors.

In the case of an imaging system having cleaning means, such a form of toner is removed by the cleaning means on an intermediate transfer medium; for a system free from any cleaning means, however, it is inevitable to prevent such a form of toner.

The present invention is now explained with reference to examples.

EXAMPLES

Preparation of Toner 1

A monomer mixture consisting of 80 parts by weight of a styrene monomer, 20 parts by weight of butyl acrylate and 5 parts by weight of acrylic acid was added to a mixed aqueous solution containing 150 parts by weight of water, 1 part by weight of a nonionic emulsifying agent (Emulgen 950 made by Dai-Ichi Kogyo Seiyaku Co., Ltd.), 1.5 parts by weight of an anionic emulsifying agent (Neogen R made by Dai-Ichi Kogyo Seiyaku Co., Ltd.) and 0.55 part by weight of potassium persulfate, and an 8-hour polymerization was carried out at 70° C. while the mixture was stirred in a nitrogen stream. After the polymerization reaction, the reaction system was cooled to obtain a milk white resin emulsion having a particle diameter of 0.25 μm.

Then, 200 parts by weight of the resin emulsion, 20 parts by weight of a polyethylene wax emulsion (made by Sanyo Kasei Kogyo Co., Ltd.) and 7 parts by weight of Phthalocyanine Blue were dispersed in water containing 0.2 part by weight of a surface active agent sodium dodecylbenzene sulfonate. Diethylamine was added to the dispersion to regulate its pH to 5.5, and 0.3 part by weight of aluminum sulfate was thereafter added as an electrolyte to the dispersion, which was then further dispersed by high speed stirring in a stirrer (TK homomixer).

Further, 40 parts by weight of a styrene monomer, 10 parts by weight of butyl acrylate and 5 parts by weight of zinc salicylate were added together with 40 parts by weight of water to the dispersion, which was then heated to 90° C. under agitation in a nitrogen stream. Then, a 5-hour polymerization was conducted with the addition of a hydrogen peroxide solution for growth of particles. After stopping the polymerization, the polymerization system was heated to 95° C. at pH controlled to 5 or higher, and held for 5 hours to increase the bond strength of associated particles.

The obtained particles were then washed with water, and dried in vacuum at 45° C. for 10 hours, thereby obtaining a cyan toner having an average particle diameter of 6.8 μm and a circularity of 0.98.

In the instant example, the circularity was measured using a flow type particle image analyzer (FPIA2100 made by Sysmex Co., Ltd.), and expressed in terms of the following formula (1):

$$R=L_0/L_1 \quad (1)$$

Here $L_1$ is the peripheral length in μm of a projected image of the toner particle to be measured, and $L_0$ is the circumferential length in μm of a true circle equal in area to the projected image of the toner particle to be measured.

One hundred (100) parts by weight of the obtained toner were added and mixed with flowability improvers, 1 part by weight of hydrophobic silica having an average primary particle diameter of 12 nm and 0.7 part by weight of hydrophobic silica having an average primary particle diameter of 40 nm. Then, the mixture was further added to and mixed with 0.5 part by weight of hydrophobic titanium oxide having an average primary particle diameter of 20 nm and 0.4 part by weight of positively chargeable hydrophobic silica obtained by surface treatment with aminosilane of hydrophobic silica having an average primary particle diameter of 30 nm, thereby obtaining a toner 1 also referred to as a cyan toner 1.

It is noted that the average particle diameter is given in terms of a volume distribution D50 measured with an electric resistance particle diameter distribution-measuring device (Multi-Sizer III made by Beckman & Coulman Co., Ltd.).

The obtained toner was found to have a work function of 5.54 eV. It is noted that the work function is given in terms of a value found by means of a surface analyzer (AC-2 Type made by Riken Kogyo Co., Ltd.) at an irradiation dose of 500 nW.

Preparation of Toner 2

Toner 2 was prepared as in toner 1 with the exception that quinacridone was used in place of the pigment Phthalocyanine Blue and the temperature for enhancement of the association of secondary particles and film bond strength was 90° C. The obtained magenta toner was found to have a circularity of 0.972, a work function of 5.63 eV and a number base average particle diameter of 6.9 μm. This toner 2 is also referred to as magenta toner 2.

Preparation of Toners 3 and 4

Polymerization was carried out as in toner 2 with the exception that the pigment was changed to Pigment Yellow 180, and the flowability improvers were added to the polymerization system, thereby preparing toner 3 having a circularity of 0.972, a work function of 5.58 eV and an average particle diameter of 7.0 μm. This toner 3 is also referred to as yellow toner 3.

Polymerization was carried out as in toner 2 with the exception that the pigment was changed to carbon black, and the flowability improvers were added to the polymerization system, thereby preparing toner 4 having a circularity of 0.973, a work function of 5.48 eV and an average particle diameter of 6.9 μm. This toner 4 is also referred to as black toner 4.

Preparation of Toner 5

One hundred (100) parts by a 1:1 by weight mixture consisting of a polycondensed polyester of an aromatic dicarboxylic acid and an alkylene etherified bisphenol A and a product partly crosslinked with a polyvalent metal compound of said polycondensed polyester (made by Sanyo Kogyo Co., Ltd.), 5 parts by weight of a cyan pigment Pigment Blue 15:1, 1 part by weight of a release agent polypropylene having a melting point of 152° C. and a weight-average molecular weight of 4,000 and 4 parts by weight of a charge control salicylic acid metal complex (E-81 made by Orient Chemical Co., Ltd.) were uniformly mixed together in a Henschel mixer, and the mixture was kneaded in a twin-screw extruder having an internal temperature of 130° C., followed by cooling.

The cooled product was crushed to 2 mm square, finely pulverized in a jet mill, and classified by a rotor classifier to obtain a classified toner having an average particle diameter of 6.2 μm and a circularity of 0.905.

One hundred (100) parts by weight of the classified toner were treated on its surface with 0.2 part by weight of hydrophobic silica (having an average primary particle diameter of 7 nm and a specific surface area of 250 $m^2/g$) The thus surface treated toner was subjected to a partial sphere-making treatment at a thermal treatment temperature of 200° C. using a hot-air sphere-making machine (SFS-3 Type made by Nippon Pneumatic Kogyo Co., Ltd.), and again classified as described above, thereby obtaining matrix particles for cyan toner 5 having an average particle diameter of 6.3 μm and a circularity of 0.940.

As in toner 1, the flowability improvers were added to and mixed with the matrix toner particles to prepare toner 5, which was found to have a work function of 5.48 eV. This toner 5 is also referred as cyan toner 5.

Preparation of Toners 6, 7 and 8

Pulverization, classification, thermal treatment and reclassification were carried out as in toner 5 with the exception that the pigment used was changed to Naphthol AS 6B, thereby preparing toner 6 which was found to have a work function of 5.53 eV. This toner 6 is also referred to as magenta toner 6.

Likewise, a yellow toner, i.e., toner 7 was prepared using Pigment Yellow 93 as the pigment. This toner 7 is also referred to as yellow toner 7.

Further, a black toner, i.e., toner 8 was prepared using carbon black as the pigment. This toner 8 is also referred to as black toner 8.

Toners 7 and 8 were found to have the same average particle diameter and circularity as in toner 6, and the work functions of the yellow and black toners were 5.57 eV and 5.63 eV, respectively.

Preparation of Toners 11, 12, 13 and 14

Toner 11 was prepared as in toner 1 with the exception that the amount of the hydrophobic titanium oxide having an average primary particle diameter of 20 nm, added as the flowability improver, was changed to 0.7 part by weight and the amount of the positively chargeable hydrophobic silica obtained by the surface treatment with aminoslane of silica having an average primary particle diameter of 30 nm was changed to 0.45 part by weight. This toner 11 is also referred to as cyan toner 11 (C11), with a work function of 5.55 eV.

Likewise, toner 12 was prepared as in toner 2 with the exception that the amount of the hydrophobic titanium oxide having an average primary particle diameter of 20 nm, added as the flowability improver, was changed to 0.7 part by weight and the amount of the positively chargeable hydrophobic silica obtained by the surface treatment with aminoslane of silica having an average primary particle diameter of 30 nm was changed to 0.45 part by weight. This toner 11 is also referred to as magenta toner 12 (M12), with a work function of 5.64 eV.

Likewise, toner 13 was prepared as in toner 3 with the exception that the amount of the hydrophobic titanium oxide having an average primary particle diameter of 20 nm, added as the flowability improver, was changed to 0.7 part by weight and the amount of the positively chargeable hydrophobic silica obtained by the surface treatment with aminoslane of silica having an average primary particle diameter of 30 nm was changed to 0.45 part by weight. This toner 13 is also referred to as yellow toner 13 (Y13), with a work function of 5.59 eV.

Likewise, toner 14 was prepared as in toner 4 with the exception that the amount of the hydrophobic titanium oxide having an average primary particle diameter of 20 nm, added as the flowability improver, was changed to 0.7 part by weight and the amount of the positively chargeable hydrophobic silica obtained by the surface treatment with aminoslane of silica having an average primary particle diameter of 30 nm was changed to 0.45 part by weight. This toner 14 is also referred to as black toner 14 (BK13), with a work function of 5.49 eV.

Preparation of Organic Photosensitive Member (OPC1)

An electrically conductive support member formed of an aluminum tube having a diameter of 85.5 mm was provided with an underlying layer by means of a ring coating process wherein a coating solution obtained by dissolving and dispersing 6 parts by weight of alcohol-soluble nylon (CM8000 made by Toray Industries, Ltd.) and 4 parts by weight of fine titanium oxide particles treated with aminosilane in 100 parts by weight of methanol was coated, and dried at 100° C. for 40 minutes to a film thickness of 1.5 to 2 μm.

One (1) part by weight of oxytitanylphthalocyanine, 1 part by weight of butyral resin (BX-1 made by Sekisui Chemical Co., Ltd.) and 100 parts by weight of dichloroethane were dispersed on the underlying layer for 8 hours by means of a sand mill using glass beads having a diameter of 1 mm.

The obtained pigment dispersion was coated on the support member by a ring coating process, and dried at 80° C. for 20 minutes to form a carrier generation layer having a thickness of 0.3 μm.

The carrier generation layer was then provided thereon with a carrier transport layer by a dip coating process wherein a solution of 40 parts by weight of a carrier transport substance comprising a styryl compound having the following structural formula (1) and 60 parts by weight of polycarbonate resin (Panlight TS made by Teijin Limited) dissolved in 400 parts by weight of toluene was coated to a dried thickness of 22 μm, thereby preparing an organic photosensitive member (OPC1) having a double-layered photosensitive layer.

A part of the obtained photosensitive member was cut out into a test piece, which was found to have a work function of 5.47 eV, as measured at an irradiation dose of 500 nW using a surface analyzer (AC-2 Type made by Riken Keiki Co., Ltd.).

Structural Formula (1)

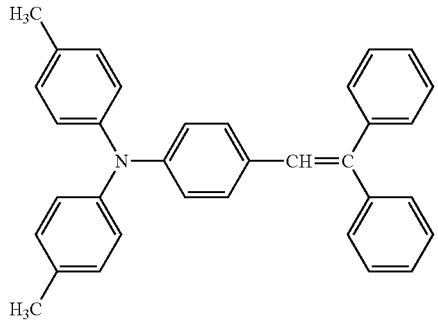

Preparation of Organic Photosensitive Member (OPC2)

An organic photosensitive member (OPC2) was prepared as in the organic photosensitive member (OPC1) with the exception that a seamless nickel electroformed tube having a thickness of 40 μm and a diameter of 85.5 mm was used in place of the aluminum tube for the electrically conductive support member, titanylphthalocyanine was used as the carrier generation agent and a distyryl compound having the following structural formula (2) was used for the carrier transport substance. As measured in the same manner as described above, this organic photosensitive member had a work function of 5.50 eV.

Structural Formula (2)

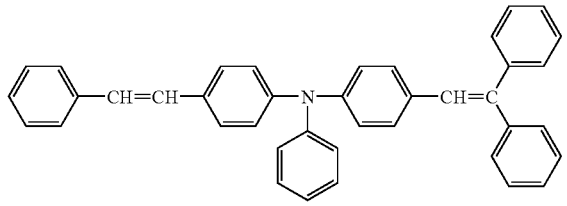

Preparation of Organic Photosensitive Member (OPC3)

An organic photosensitive member (OPC3) was prepared as in the organic photosensitive member (OPC1) with the exception that an aluminum tube having a diameter of 30 mm was used for the electrically conductive support member.

Fabrication of Development Roller

A nickel layer having a thickness of 10 μm was plated on the surface of an aluminum tube having a diameter of 18 mm in such a way as to provide a surface roughness (Rz) of 4 μm. The surface of this development roller was found to be 4.58 eV.

Fabrication of Regulated Blade

A 1.5-mm thick, electrically conductive urethane chip was applied to an 80-μm thick stainless sheet by means of an electrically conductive bonding agent to allow an urethane portion to have a work function of 5 eV.

Fabrication of Intermediate Transfer Belt 1

A uniform dispersion consisting of 30 parts by weight of a vinyl chloride-vinyl acetate copolymer, 10 parts by weight of electrically conductive carbon black and 70 parts by weight of methyl alcohol was coated onto a 130-μm thick polyethylene terephthalate film with aluminum deposited by evaporation by a roll coating process, and dried in such a way as to provide an intermediate, electrically conductive layer having a thickness of 20 μm. Then, a coating solution obtained by mixing and dispersing together 55 parts by weight of a nonionic aqueous urethane resin (having a solid content of 62%), 11.6 parts by weight of a polytetrafluoroethylene emulsion (having a solid content of 60%), 25 parts by weight of electrically conductive tin oxide, 34 parts by weight of polytetrafluoroethylene fine particles (having a maximum particle diameter of up to 0.3 μm), 5 parts by weight of a polyethylene emulsion (having a solid content of 35%) and 20 parts by weight of ion exchanged water was coated by a roll coating process and dried to a thickness of 10 μm.

The coated sheet was cut to a length of 540 mm, and the sheet material was ultrasonically fused at butting ends with the coated surface upside, thereby fabricating an intermediate transfer belt. The obtained intermediate transfer belt was found to have a volume resistance of $2.5\times10^{10}$ Ω·cm, a work function of 5.37 eV and a normalized photoelectron yield of 6.90.

Fabrication of Intermediate Transfer Belt 2

An intermediate transfer belt was fabricated as in intermediate transfer belt 1 with the exception that 2 parts by weight of electrically conductive titanium oxide, 25 parts by weight of electrically conductive tin oxide and 37 parts by weight of polytetrafluoroethylene fine particles were used on the same intermediate, electrically conductive layer.

The obtained intermediate transfer belt was found to have a volume resistance of $1.1\times10^{10}$ Ω·cm, a work function of 5.52 eV and a normalized photoelectron yield of 7.25.

Fabrication of Intermediate Transfer Belt 3

Eighty-five (85) parts by weight of polybutylene terephthalate, 15 parts by weight of polycarbonate and 15 parts by weight of acetylene black were premixed in a mixer in a nitrogen atmosphere, and the obtained mixture was kneaded through a twin-screw extruder again in a nitrogen atmosphere to obtain a pellet.

This pellet was then extruded through a single-screw extruder having an annular die at 260° C. into a tube form of film having an outer diameter of 170 mm and a thickness of 160 μm. The inner diameter of the extruded molten tube was then controlled by a cooling inside mandrel supported on the same axis as the annular die, after which the tube was cooled and solidified to fabricate a seamless tube, which was in turn cut to the predetermined size, thereby obtaining a seamless belt having an outer diameter of 172 mm, a width of 342 mm and a thickness of 150 μm.

The obtained intermediate transfer belt was found to have a volume resistance of $3.2\times10^{8}$ Ω·cm, a work function of 5.19 eV and a normalized photoelectron yield of 10.88.

EXAMPLE 1

An intermediate transfer medium-incorporating four-cycle full-color printer, comprising one specific organic photosensitive member (OPC1) and the above development roller and regulated blade, as shown in FIG. 4, with developing cartridges storing toners 1 to 4 mounted in place, was used in combination with the above transfer belt 1 to conduct imaging tests according to the non-contact one-component development process.

The imaging conditions applied were such that the organic photosensitive member had a peripheral speed of 180 m/sec., and the peripheral speed ratio of the development roller to the organic photosensitive member was 1.6, and the peripheral speed difference between the organic photosensitive member and the intermediate transfer medium or transfer belt was such that the transfer belt rotated a 3% faster than the former. The reason was that at a difference of greater than 3%, dust would cling to transferred images. The control conditions for the toner regulated blade were such that the amount of the toners delivered on the development roller was 0.4 mg/cm$^2$.

The imaging conditions applied were also such that the gap between the development roller and the photosensitive member was 210 mm, and the devlopment and feed rollers were at the same potential while the frequency of an AC current superposed on a DC developing bias voltage of −200 V was 2.5 kHz and the peak-peak voltage was 1,400 V.

Furthermore, the imaging conditions for the printer of FIG. 4 were such that the amount of the toner of each color in a solid image on the photosensitive member varied in the range of 0.5 mg/cm$^2$ to 0.53 mg/cm$^2$. In response to data on solid images, toners of three colors were then formed on the photosensitive member. After this, the efficiency of transfer of the toners onto the intermediate transfer belt was found at varying primary transfer voltages.

Measurement of Transfer Efficiency

1. Amount of Toner Deposited upon Development

The amount of the toner in the solid image of each color deposited on the photosensitive member upon development was transferred onto an adhesive tape to measure the mass of the tape before and after the application of the tape. In this tape transfer method, the difference was measured in terms of toner mass (mg/cm$^2$).

The amount of deposition upon development of the toners of two or more colors put one upon another was again found by the tape transfer method to check whether or not the overall mass of the amounts of the respective colors combined was in agreement with the mass of the toners of four colors put one upon another within an allowable error range.

2. Measurement of Toner Transfer Efficiency

The post-transfer weight of toner residues on the organic photosensitive member at varying primary transfer voltages was read in the form of image data under an optical microscope, and the image data were processed to find the area of the post-transfer toner and the number of toner particles per unit area. Then, the post-transfer mass of each toner per unit area was found from the number of toner particles and the volume and true density of each toner determined from these values. The transfer efficiency was determined in terms of the ratio of the post-transfer mass to the amount of the toner deposited upon development.

Regarding the order of development and transfer at varying primary transfer voltages, experimental results are set out in Table 1 with cyan toner 1 (C1 having a work function of 5.55 eV), magenta toner 2 (M2 having a work function of 5.64 eV), yellow toner 3 (Y3 having a work function of 5.59 eV) and black toner 4 (BK4 having a work function of 5.49 eV).

TABLE 1

| Order of Development and Transfer | Primary Transfer Voltage +400 V | +500 V | +600 V |
|---|---|---|---|
| Ex. 1-1 (M2-Y3-C1) | 97.29% | 99.47% | 99.72% |
| Ex. 1-2 (Y3-C1-BK4) | 97.93% | 99.78% | 99.88% |
| Comp. Ex. 1-1 (M2-C1-Y3) | 92.22% | 98.31% | 99.11% |
| Comp. Ex. 1-2 (Y3-C1-M2) | 91.36% | 97.86% | 99.06% |
| Comp. Ex. 1-3 (C1-M2-Y3) | 92.78% | 98.90% | 99.39% |
| Comp. Ex. 1-4 (BK4-Y3-C1) | 92.55% | 98.73% | 99.08% |
| Comp. Ex. 1-5 (C1-Y3-BK4) | 92.80% | 98.93% | 99.40% |

From the results of Table 1, it is found that high transfer efficiency can be achieved by carrying out development and transfer in descending toner work function order. Higher transfer efficiency is obtainable at lower transfer voltage areas in particular; however, the transfer voltage should preferably be as low as possible, because increased transfer voltages are responsible for toner scatterings and transfer memories at low image duties or in conjunction with reproducibility of line images. In view of enhanced transfer efficiency, therefore, the development and transfer should preferably be carried out in descending toner work function order.

EXAMPLE 2

An intermediate transfer medium-incorporating four-cycle full-color printer, comprising another specific organic photosensitive member (OPC2) and the same development roller and regulated blade as in Example 1, as shown in FIG. 4, with developing cartridges storing toners 1 to 4 mounted in place, was used in combination with the above transfer belt 2 to conduct imaging tests according to the non-contact one-component development process.

Imaging was carried out under substantially the same conditions as in Example 1, however, with the exception that the dark and light potentials of the photosensitive member was −600 V and −60 V, respectively, the standard developing bias voltage was −200 V, and the development and feed rollers were at the same potential. Further, the control conditions for the above toner regulated blade were changed such that the amount of the toners delivered on the development roller was varied in the range of 0.4 mg/cm$^2$ to 0.43 mg/cm$^2$.

Furthermore, the imaging conditions for the printer applied were broken down into two sets of conditions, i.e., (1) under which the amount of each toner in a solid image deposited on the photosensitive member upon development was in the range of 0.5 mg/cm$^2$ to 0.54 mg/cm$^2$, and (2) under which the amount of each toner was 0.58 mg/cm$^2$ to 0.6 mg/cm$^2$. Transfer tests were conducted in otherwise the same manner as in Example 1.

Experimental results obtained in the order of development and transfer at varying primary transfer voltages are set out in Tables 2 and 3.

TABLE 2

| Imaging Conditions (1): Amount of Toner Deposition upon Development: 0.5 mg/cm$^2$ to 0.54 mg/cm$^2$ | | | |
|---|---|---|---|
| Order of Development and Transfer | Primary Transfer Voltage +300 V | +400 V | +500 V |
| Example 2-1 (M2-Y3-C1) | 95.11% | 99.26% | 99.92% |
| Comp. Ex. 2-1 (Y3-C1-M2) | 91.40% | 97.92% | 99.08% |
| Comp. Ex. 2-2 (C1-M2-Y3) | 92.28% | 98.53% | 99.13% |
| Comp. Ex. 2-3 (Y3-M2-C1) | 92.90% | 98.91% | 99.40% |

TABLE 3

| Imaging Conditions (2): Amount of Toner Deposition upon Development: 0.58 mg/cm$^2$ to 0.6 mg/cm$^2$ | | | |
|---|---|---|---|
| Order of Development and Transfer | Primary Transfer Voltage +300 V | +400 V | +500 V |
| Example 2-2 (M2-Y3-C1) | 93.29% | 98.91% | 99.70% |
| Comp. Ex. 2-4 (Y3-C1-M2) | 90.01% | 96.29% | 98.01% |
| Comp. Ex. 2-5 (C1-M2-Y3) | 91.16% | 97.11% | 98.35% |
| Comp. Ex. 2-6 (Y3-M2-C1) | 91.33% | 97.33% | 99.05% |

From the results of Tables 2 and 3, it is found that high transfer efficiency can be achieved by carrying out development and transfer in descending toner work function order as in the invention; however, when the amount of the toners deposited on the organic photosensitive member upon development comes close to 0.6 mg/cm$^2$ in the imaging condition set (2), the transfer efficiency tends to become lower at the primary transfer voltage for the constant voltage process than that in the imaging condition set (1) at which the amount of the toners deposited upon development is reduced. This is because the transfer electric field intensity becomes unfavorable, indicating that the amount of the toner deposited for each color upon development should preferably be 0.55 mg/cm$^2$ or lower.

EXAMPLE 3

Imaging was carried out with a full-color printer comprising a tandem type integrated photosensitive member process cartridge assembly, with the above toners 5 to 8 mounted on the respective color developing portions, as shown in FIG. 5, by the non-contact one-component developing process. The toners used were cyan toner 5 having a work function of 5.48 eV, magenta toner 6 having a work function of 5.53 eV, yellow toner 7 having a work function of 5.57 eV and a black toner 8 having a work function of 5.63 eV.

For development and transfer, the respective process cartridges were mounted in a descending work function order of black toner 8, yellow toner 7, magenta toner 6, and cyan toner 5.

The organic photosensitive member was formed as in the organic photosensitive member (OPC1), using an aluminum tube having a diameter of 30 mm as the electrically conductive support member. Titanylphthalocyanine was used as the carrier generation substance and the distyryl compound of structural formula (2) as the carrier transport substance.

The development roller and regulated blade were constructed as in Example 1, and the intermediate transfer medium was fabricated as in the fabrication of the intermediate transfer belt 2. The conditions for the regulated blade were such that the amount of the toner of each color delivered was in the range of 0.4 gm/cm$^2$ to 0.43 mg/cm$^2$.

Imaging was carried out with continuously fed 10,000 textual input documents corresponding to 5% color documents for each color at an AC frequency of 2.5 kHz superposed on a DC development bias voltage of −200 V and a peak-peak voltage of 1,400 V. By measurement, the amount of the cleaning toners on four photosensitive members and the intermediate transfer belt was found to be 40 grams in all.

This amount was about ⅓ of the amount of toners collected in a conventional cleaning toner collector vessel.

EXAMPLE 4

As in Example 1, an intermediate transfer medium-incorporating four-cycle full-color printer, comprising the organic photosensitive member (OPC1) and the same development roller and regulated blade as in Example 1, as shown in FIG. 4, with developing cartridges storing toners 1 to 4 mounted in place, was used in combination with the above transfer belt 3 to conduct imaging tests according to the non-contact one-component development process.

For the primary transfer site a constant-voltage power supply was used with the application of a DC voltage of +370 V, and for the secondary transfer site a constant current power supply was used with a constant current control of 16 μA.

For imaging, the peripheral speed ratio of the development roller to the organic photosensitive member having a peripheral speed of 180 mm/sec. was 1.6, and the peripheral speed difference between the organic photosensitive member and the intermediate transfer medium or transfer belt was such that the transfer belt rotated a 3% faster than the former.

The upper limit of 3% to the peripheral speed difference was determined because dust would clung to transferred images at greater than 3%. The control conditions for the toner regulated blade were such that the amount of the toners delivered on the development roller was 0.4 mg/cm$^2$.

The toners used were cyan toner 1 having a work function of 5.54 eV, magenta toner 2 having a work function of 5.63 eV, yellow toner 3 having a work function of 5.58 eV and black toner 4 having a work function of 5.48 eV. Development and transfer were carried out in descending toner work function order of magenta toner 2, yellow toner 3, cyan toner 1 and black toner 4.

Imaging was carried out with continuously fed 10,000 textual input documents corresponding to 5% color documents for each color at a nip of 210 μm between the development roller and the photosensitive member, an AC frequency of 2.5 kHz superposed on a DC development bias voltage of −200 V and a peak-peak voltage of 1,400 V while the development and feed rollers were at the same potential.

By measurement, the amount of the waste cleaning toners on the photosensitive members and intermediate transfer belt was found to be 15 grams in all.

This amount was 1/13 of that resulting from the use of a conventional pulverization toner having a circularity of 0.91 with no order of development and transfer in mind.

EXAMPLE 5

A color printer was built up of the organic photosensitive member (OPC3), the development roller, the regulated blade and the intermediate transfer medium of FIG. 6 with the intermediate transfer belt 3 mounted thereon, as used in the previous examples. However, no cleaning means was relied upon.

Only a developing cartridge with the above cyan toner 11 loaded therein was used for imaging tests according to the non-contact one-component development process.

Imaging was carried out such that the peripheral speed ratio of the development roller to the organic photosensitive member having a peripheral speed of 105 mm/sec. was 1.6, and the peripheral speed difference between the organic photosensitive member and the intermediate transfer medium, i.e., the transfer belt was such that the transfer belt rotated a 2.5% faster than the former.

At a difference of greater than 3%, preliminary experimentation already indicated that dust clung to transferred images; that difference was set at 2.5%. The control conditions for the toner regulated blade were varied such that the amount of the toners delivered on the development roller came within the range shown in Table 1.

Imaging conditions were such that the dark and light potentials of the photosensitive member were −600 V and −80 V, respectively, the development bias voltage was −200 V, the nip between the development roller and the photosensitive member was 210 μm, the frequency of an AC current superposed on the DC development bias voltage of −200 V was 2.5 kHz, the P—P voltage was 1,400 V, and the development and feed rollers were at the same potential. For a primary transfer site a constant-voltage power supply was used with a transfer voltage of +65 V, and for a secondary transfer site a constant-current DC power supply was used.

Printing, primary transfer, secondary transfer and fixation were carried in such a way as to provide entirely solid images, thereby obtaining cyan solid images. The reflection density of the solid images was measured with a densitometer (404 Model made by X-Rite Co., Ltd.).

Solid images were obtained at varying amounts of the toner delivered. Then, the development roller was taken out of the developing cartridge to measure the charge properties of the toner on the development roller with a charge quantity distribution analyzer (E-SPART Analyzer EST-3 Model made by Hosokawa Micron Co., Ltd.). The results are set out in Table 4.

Measuring conditions were such that the suction flow rate was 0.2 L/min., the flow rate of duct collection air was 0.6 L/min., the electric field voltage was 100 V, the X-axis was 0.1 mm/sec., and the maximum count was 3,000.

In Comparative Examples 5-3, similar measurement was made with a cyan toner for a color printer (Offirio LP-1500C made by Seiko Epson Co., Ltd.) with multi-layers for control purposes. The results are also shown in Table 4.

TABLE 4

| | Delivery Amount (mg/cm$^2$) | Solid Images OD Values | Average Charge Quantity (μC/g) | Number of + Toner Particles (%) |
|---|---|---|---|---|
| Example 5-1 | 0.31 | 1.316 | −16.00 | 3.1 |
| Example 5-2 | 0.40 | 1.403 | −11.48 | 4.2 |
| Comp. Ex. 5-1 | 0.52 | 1.423 | −9.79 | 5.7 |
| Comp. Ex. 5-2 | 0.55 | 1.433 | −8.14 | 9.0 |
| Comp. Ex. 5-3 | 0.37 | 0.83 | −19.31 | 1.2 |

Table 4 implies that as the amount of the toner delivered decreases, the average quantity of charges increases with decreasing solid image density and a decrease in the number of positively charged toner particles (%). Conversely, as the amount of the toner delivered increases, the average quantity of charges decreases with increasing solid image density and an increase in the number of positively charged toner particles (%)

It is thus found that satisfactory results are obtainable when the amount of the toner delivered is 0.5 mg/cm$^2$ or less and the average quantity of charges has a negative absolute value of 16 μC/g or less. In particular, the number of + toner particles is kept at a value of 5% or less at −16 μC/g to −10 μC/g, assuring satisfactory solid images.

In the comparative example wherein the non-magnetic polymerization toner for multi-layer control was provided in a thin film form, say, in a substantially single layer form, however, it is found that the number of + toner particles (%) decreases but the absolute value of the average quantity of charges increases, resulting in a decrease in the density of solid images.

EXAMPLE 6

A color printer as shown in FIG. 4 was built up of the organic photosensitive member (OPC2) with a development roller and a regulated blade attached thereto as in Example 4. The color printer, with a developing cartridge assembly having toners 1 to 4 loaded therein, was used in combination with the intermediate transfer belt 1 to conduct imaging tests according to the contact one-component developing process.

Imaging was carried out such that the peripheral speed ratio of the development roller to the organic photosensitive member having a peripheral speed of 180 mm/sec. was 1.6, and the peripheral speed difference between the organic photosensitive member and the intermediate transfer medium, i.e., the transfer belt was such that the transfer belt rotated a 3% faster than the former. At a difference of greater than 3%, dust was generated from transferred images; this was the reason for placing the upper limit of that difference at 3%.

The control conditions for the toner regulated blade were varied such that the amount of the toners delivered on the development roller was 0.35 mg/cm$^2$, 0.4 mg/cm$^2$ and 5 mg/cm$^2$.

Imaging conditions were such that the dark and light potentials of the photosensitive member were −600 V and −80 V, respectively, the development bias voltage was −200 V and the development and feed rollers were at the same potential. For a primary transfer site a constant-voltage power supply was used at a transfer voltage of +500 V, and a developing cartridge was loaded with 150 grams of toner.

A textual input document corresponding to 5% color document for each color and an N-2A "cafeteria" image according to standard image data in compliance with JIS X9201-1995 were continuously printed with a color printer as shown in FIG. 6.

To which degree the quality of output images degraded from the initial quality was evaluated with output images using the 5% color input document and the input natural image N-2A.

The target number of output images were 10,000 for the former input document and 5,000 for the latter input image. For the purpose of comparison, continuous printing was also performed on the printer with a cleaning blade attached thereto.

At the point at which color misalignments for the reasons of poor transfer and fogging as well as color mixing due to back transfer occurred, the service life of the toners in the developing units was judged as expiring. The results are set out in Table 5.

It is noted that as transfer efficiency become low or when fogging occurs or much toner is back transferred, the toner of other color would enter the next developer, rendering reproduction of pure color difficult as a result of the occurrence of color mixing.

The toners used were cyan toner 11 (C11 having a work function of 5.55 eV), magenta toner 12 (M12 having a work function of 5.64 eV), yellow toner 13 (Y13 having a work function of 5.59 eV) and black toner 14 (BK4 having a work function of 5.49 eV).

It is noted that whenever the order of development and transfer was varied, the order of image date processing was varied for continuous printing.

TABLE 5

| Test Run No. Order of Development & Transfer | Amount of Toner Delivered (mg/cm$^2$) | Number of output images where color misalignments due to color mixing were allowable: With cleaning 5% color | With cleaning N2A | With no cleaning 5% color | With no cleaning N2A |
|---|---|---|---|---|---|
| 6-1* | 0.35 | 10,000 | 5,000 | 10,000 | 5,000 |
| 6-2* | 0.4 | 10,000 | 5,000 | 10,000 | 4,800 |
| 6-3* | 0.5 | 10,000 | 5,000 | 8,200 | 3,000 |
| 6-4* | 0.35 | 10,000 | 5,000 | 9,900 | 4,100 |
| 6-5* | 0.4 | 10,000 | 5,000 | 7,200 | 3,900 |
| 6-6* | 0.5 | 10,000 | 5,000 | 5,900 | 2,900 |
| 6-7* | 0.35 | 10,000 | 5,000 | 7,100 | 2,850 |

6-1* (M12-Y13-C11-BK14)
6-2* (M12-Y13-C11-BK14)
6-3* (M12-C11-Y13-BK14)
6-4* (M12-C11-Y13-BK14)
6-5* (Y13-C11-M12-BK14)
6-6* (Y13-C11-M12-BK14)
6-7* (BK14-Y13-C11-M12)

The results of Table 5 indicate that by using an intermediate transfer belt whose work function is smaller than the work functions of the toner to control the amount of the toner delivered to 0.5 mg/cm$^2$ or lower, it is possible to provide an imaging system in a so-called cleaner-free form in which there is no cleaning blade.

It is also noted that by carrying out development and transfer in descending toner work function order, it is possible to achieve much higher transfer efficiency, and that the use of a toner having the largest work function for the first color is important to achieve the desired cleaner-free system.

The charge properties of each toner delivered on the development roller in an amount of 0.4 mg/cm$^2$ were determined according to Example 5. The results are shown in Table 6.

TABLE 6

| Toner | Average Quantity of Charges (μC/g) | Number of + Toner Particles (%) |
|---|---|---|
| Cyan Toner 11 | −11.48 | 4.2% |
| Magenta Toner 12 | −15.39 | 3.1% |
| Yellow Toner 13 | −14.11 | 4.5% |
| Black Toner 14 | −12.05 | 4.9% |

As shown in Table 6, in all the average quantities of charges on the toners of the invention, the absolute value of the negatively charged toner was not greater than −16 μC/cm$^2$, and the number of + toner particles was 5% or lower.

For imaging, a DC constant-voltage power supply was used for a primary transfer site in the color printer, and a constant-current power supply was used for a secondary transfer site. The fact that a DC power supply can be used as the constant-voltage power supply is favorable in view of toner scattering or dispersion, and the use of the constant-current DC power supply for the secondary transfer site is favorable because stable transferability is achievable regardless of the type of paper. At the secondary transfer site, a constant current of 16 μA was passed.

EXAMPLE 7

Figure 7:
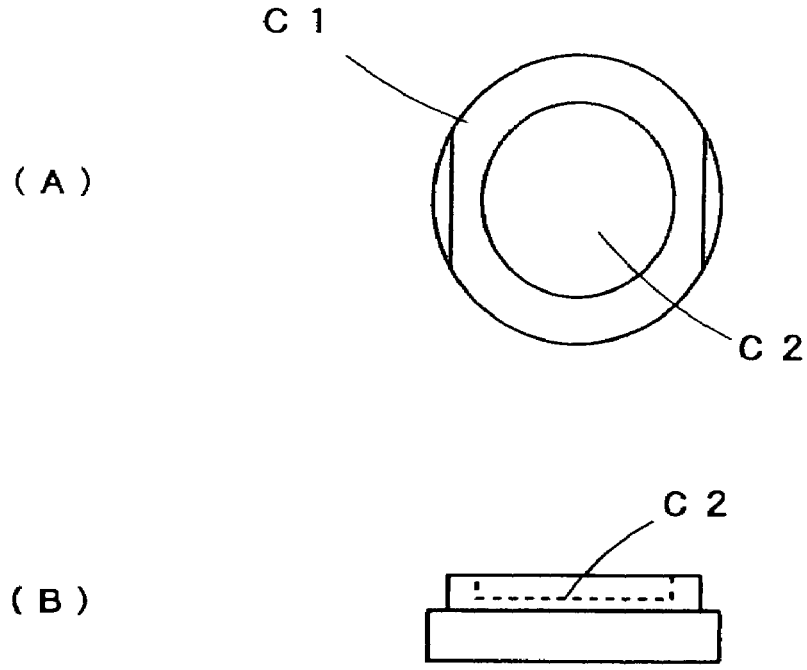
FIGS. 7(A) and 7(B) are illustrative of one specific sample measurement cell used for measurement of work functions.

A color printer as shown in FIG. 7 was built up of the organic photosensitive member (OPC3), development roller and regulated blade used in the previous example. The color printer, with a developing cartridge assembly with the above color toners 11 to 14 loaded therein, was used in combination with the intermediate transfer belt 3 for performing continuous printing test runs by the non-contact one-component development process.

Imaging was carried out under standard imaging conditions wherein the dark and light potentials of the photosensitive member were −600 V and −80 V, respectively, the nip between the development roller and the photosensitive member was regulated to 210 μm, the frequency of an AC current superposed on a DC development bias voltage of −200 V was 2.5 kHz, the P—P voltage was 1,400 V and the development and feed rollers were at the same potential. Printing was then controlled such that the amount of deposition of the toner of each color developed on the photosensitive member upon solid printing was 0.53 mg/cm$^2$ at most.

The control conditions for the toner regulated blade were adjusted such that the amount of the toner delivered on the development roller came in the range of 0.35 mg/cm$^2$ to 0.4 mg/cm$^2$, and the amount of development on the photosensitive member came in the range of 0.5 mg/cm$^2$ to 0.53 mg/cm$^2$ for each color of toner.

As in Example 6, a textual input document corresponding to 5% color document for each color and an N-2A "cafeteria" image according to standard image data in compliance with JIS X9201-1995 were continuously printed with the color printer as shown in FIG. 6. The target number of output images were 10,000 for the former input document and 5,000 for the latter input image. The results are set out in Table 7.

For a primary transfer site in the color printer, a DC constant-voltage power supply was used, and for a secondary transfer site a DC constant-current power supply was used.

Development and transfer were carried out in descending toner work function order, and whenever that order was varied, the order of image data process was changed for printing.

Table 7 shows the number of output images where color misalignments appeared to occur from the initial output quality.

TABLE 7

| Test Run No. (Order of Development and Transfer | Number of output images where color misalignments due to color mixing are allowable | |
|---|---|---|
| | 5% Color | N2A |
| 7-1 (M12-Y13-C11-BK14) | 10,000 | 5,000 |
| 7-2 (M12-C11-Y13-BK14) | 9,960 | 4,850 |
| 7-3 (BK14-Y13-C11-M12) | 7,300 | 3,000 |

From Table 7 it is found that by limiting the amount of toner delivery to substantially one layer and setting the amount of the toner developed on the photosensitive member (OPC) for each color at 0.5 mg/cm$^2$ to 0.53 mg/cm$^2$, it is possible to achieve a cleaner-free system. However, when the amount of the toner deposited for a one-color solid image developed on the photosensitive member was set in the vicinity of 0.6 mg/cm$^2$ at most, transfer efficiency would become lower than would be achieved under imaging conditions with a reduced amount of toner deposition upon development. This holds true even when the primary transfer voltage of the constant-voltage process is brought up to about +700 V that is the upper limit to common transfer conditions. As a result, the number of output images where color misalignments due to color mixing are allowable is 5,100 for the 5% color input image and the N2A input image, indicating that the upper limit to the amount of the toner on the photosensitive member necessary for achieving a cleaner-free system is exceeded.

Even when the transfer voltage at the primary transfer site is set at +700 V, it is impossible to prevent color mixing, because the transfer electric field intensity is adversely affected. It is thus preferable that the amount of the toner deposited upon development for each color is 0.55 mg/cm$^2$ or lower.

According to the invention, the toner having a high circularity is used with $\Phi T \geqq \Phi TM$ where $\Phi T$ is the work function of the toner and $\Phi TM$ is the work function of the intermediate transfer medium, so that the toner transferred on the intermediate transfer medium is prevented from becoming positively charged. It is thus possible to achieve a cleaner-free system. This would be because the charge properties of the color toner are so stable that quality degradation in output images can be reduced.

As described above, the present invention provides an imaging system in which toners of two or more colors are put one upon another on an intermediate transfer medium, and then transferred by constant voltage transfer onto a recording material such as paper, wherein development and transfer are successively carried out on the intermediate transfer medium in descending toner work function order.

This ensures that the toners of two or more colors put one upon another are precisely registered one upon another, so that images of higher quality can be formed with high color reproducibility, higher transfer efficiency can be achieved and the amount of toner residues on the latent image carrier can be considerably reduced or the amount of the toner collected from the latent image carrier as toner residues upon transfer can be considerably reduced. It is thus possible to provide an imaging system having a waste toner vessel of reduced volume or a small-size imaging system having no cleaning means.

What we claim is:

1. An imaging system method comprising:

forming an electrostatic latent image on a latent image carrier;

developing the electrostatic latent image to form toner images by respectively transferring colors one upon another using a black toner or other toners of two or more colors onto an intermediate transfer medium, wherein at least a toner having a largest work function is transferred first onto the intermediate transfer medium.

2. The imaging system method according to claim 1, wherein the toner images are successively formed on the intermediate transfer medium, and the method further comprising fixing the thus formed toner images by transferring, in one operation, the thus formed toner images onto a recording material.

3. The imaging system method according to claim 1 or 2, further comprising developing the electrostatic latent image in descending work function order of the respective toners of the two or more colors, and successively transferring the respective toner images onto the intermediate transfer medium at a transfer voltage fed from a constant-voltage power supply.

4. The imaging system method according to claim 1, wherein there is no cleaner for removal of toner residues remaining on the latent image carrier after transfer.

5. The imaging system method according to claim 1, wherein an average quantity of charges on a toner having a same polarity as the latent image carrier has an absolute value of 16 μC/g or lower, and a number of toner particles contained in the toners on the latent image carrier after development and transfer onto a recording material and opposite in polarity to the electrostatic latent image on a photo conductor, is 5% or lower.

6. The imaging system method according to claim 1, wherein the latent image carrier is an organic photo conductor.

7. The imaging system method according to claim 1, further comprising reversely developing a negatively charged toner.

8. The imaging system method according to claim 1, further comprising developing a non-magnetic one-component toner, wherein an amount of the non-magnetic one-component toner developed on the latent image carrier is controlled to 0.55 $mg/cm^2$ or lower.

9. The imaging system method according to claim 1, further comprising rotating a development roller and the latent image carrier such that a peripheral speed ratio of the development roller to the latent image carrier is at least 1.1 to 2.5.

* * * * *